US011730278B2

(12) United States Patent
Ohno et al.

(10) Patent No.: US 11,730,278 B2
(45) Date of Patent: Aug. 22, 2023

(54) MATTRESS, SHEET, BED SYSTEM, AND AIR CELL

(71) Applicant: PARAMOUNT BED CO., LTD., Tokyo (JP)

(72) Inventors: Kenta Ohno, Tokyo (JP); Makoto Tanaka, Tokyo (JP); Takayuki Arimatsu, Tokyo (JP)

(73) Assignee: PARAMOUNT BED CO., LTD., Tokyo (JP)

( * ) Notice: Subject to any disclaimer, the term of this patent is extended or adjusted under 35 U.S.C. 154(b) by 84 days.

(21) Appl. No.: 17/330,691

(22) Filed: May 26, 2021

(65) Prior Publication Data

US 2021/0378413 A1 Dec. 9, 2021

(30) Foreign Application Priority Data

Jun. 9, 2020 (JP) ..... 2020-100195

(51) Int. Cl.
*A47C 27/10* (2006.01)
*A47C 27/08* (2006.01)
*A47C 31/00* (2006.01)

(52) U.S. Cl.
CPC ..... *A47C 27/10* (2013.01); *A47C 27/083* (2013.01); *A47C 31/008* (2013.01)

(58) Field of Classification Search
CPC ..... A47C 27/08; A47C 27/081; A47C 27/082; A47C 27/083; A47C 27/084; A47C 27/087; A47C 27/10; A47C 31/008
See application file for complete search history.

(56) References Cited

U.S. PATENT DOCUMENTS

| | | | | |
|---|---|---|---|---|
| 4,914,771 | A * | 4/1990 | Afeyan | A61G 7/05792 5/713 |
| 5,142,720 | A * | 9/1992 | Kelso | A61G 7/001 5/648 |
| 5,657,499 | A * | 8/1997 | Vaughn | B60N 2/914 297/284.6 |
| 5,966,763 | A * | 10/1999 | Thomas | A47C 27/086 5/911 |
| 6,370,716 | B1 * | 4/2002 | Wilkinson | A61G 7/05776 297/452.41 |
| 6,810,542 | B1 * | 11/2004 | Mitchell | A61H 9/0078 5/644 |
| 9,756,955 | B2 * | 9/2017 | Alder | A47C 27/081 |
| 10,143,609 | B2 * | 12/2018 | Chiang | A61G 7/05776 |
| 2003/0208848 | A1 * | 11/2003 | Flick | A61G 7/05769 5/713 |
| 2004/0128772 | A1 * | 7/2004 | Branson | A61G 7/05776 5/713 |

(Continued)

FOREIGN PATENT DOCUMENTS

| | | |
|---|---|---|
| JP | 2013-116188 A | 6/2013 |
| JP | 2014-046042 A | 3/2014 |

*Primary Examiner* — David R Hare
*Assistant Examiner* — George Sun
(74) *Attorney, Agent, or Firm* — Renner, Otto, Boisselle & Sklar, LLP

(57) ABSTRACT

A mattress including air cells that are located on both sides of a user, in which the air cells each have a convex shape on a first side surface, and the air cells are arranged so that the convex shapes thereof are respectively located near shoulder blade outer edges of the user.

15 Claims, 15 Drawing Sheets

(56) References Cited

U.S. PATENT DOCUMENTS

| | | | | |
|---|---|---|---|---|
| 2007/0143928 | A1* | 6/2007 | Biggie | A61G 7/05776 5/713 |
| 2011/0047703 | A1* | 3/2011 | Tarsaud | A61G 7/001 5/607 |
| 2014/0210250 | A1* | 7/2014 | DiFelice | A61G 5/1045 297/452.48 |
| 2015/0101126 | A1* | 4/2015 | Reiners | A61G 7/1023 5/715 |
| 2017/0367489 | A1* | 12/2017 | Marson | A47C 27/084 |
| 2019/0174931 | A1* | 6/2019 | Ohno | A47C 27/083 |

* cited by examiner

FIG. 9

| | DURING AUTOMATIC BODY POSITION CHANGE | | |
|---|---|---|---|
| | SLEEPING COMFORT | DISPLACEMENT | MUSCLE TONE |
| MATTRESS OF THIS DISCLOSURE | 5 | 4．8 | 4．9 |
| EXISTING MATTRESS | 4．1 | 3．5 | 4．3 |

MATTRESS, SHEET, BED SYSTEM, AND AIR CELL

FIELD

This disclosure relates to a mattress and the like.

BACKGROUND

Heretofore, in order to prevent bed sores of a user, there has been a mattress that is provided with sub-air cells for body position change. The sub-air cells are cylindrical air cells that are arranged on both sides (e.g., at the shoulders, knees, waist, and buttocks) of the user. In addition, some of such existing sub-cells are arranged in parallel with the longitudinal direction of a mattress (JP-A-2014-046042 and JP-A-2013-116188, for example)

BRIEF DESCRIPTION OF THE DRAWINGS

FIG. 9 is an explanatory chart of a result in the embodiment of this disclosure.

DETAILED DESCRIPTION

Figure 1A:
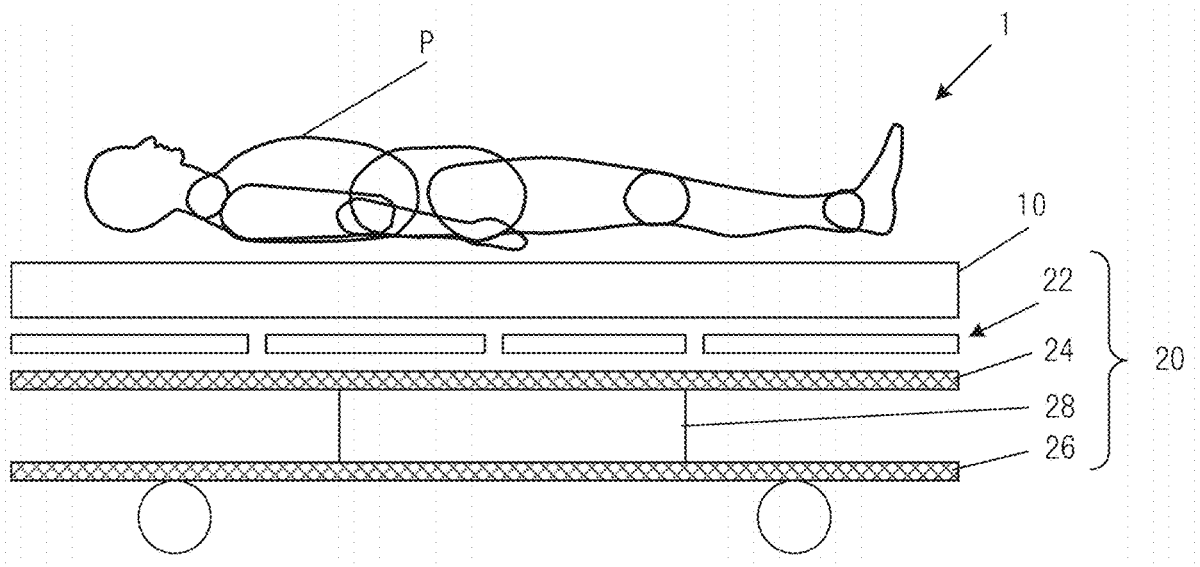
FIG. 1A is a schematic diagram illustrating a system in an embodiment of this disclosure.

One or more embodiments are now described with reference to the drawings, wherein like reference numerals are used to refer to like elements throughout. In the following description, for purposes of explanation, numerous specific details are set forth in order to provide a thorough understanding of the various embodiments. It is evident, however, that the various embodiments can be practiced without these specific details (and without applying to any particular networked environment or standard).

As used in this disclosure, in some embodiments, the terms "component," "system" and the like are intended to refer to, or comprise, a computer-related entity or an entity related to an operational apparatus with one or more specific functionalities, wherein the entity can be either hardware, or a combination of hardware and software in execution.

One or more components may reside within a process and/or thread of execution and a component may be localized on one computer and/or distributed between two or more computers. In addition, these components can execute from various computer readable media having various data structures stored thereon. The components may communicate via local and/or remote processes such as in accordance with a signal having one or more data packets (e.g., data from one component interacting with another component in a local system, distributed system, and/or across a network such as the Internet with other systems via the signal). As another example, a component can be an apparatus with specific functionality provided by mechanical parts operated by electric or electronic circuitry, which is operated by a software application or firmware application executed by a processor, wherein the processor can be internal or external to the apparatus and executes at least a part of the software or firmware application. As yet another example, a component can be an apparatus that provides specific functionality through electronic components without mechanical parts, the electronic components can comprise a processor therein to execute software stored on a non-transitory electronic memory or firmware that confers at least in part the functionality of the electronic components. While various components have been illustrated as separate components, it will be appreciated that multiple components can be implemented as a single component, or a single component can be implemented as multiple components, without departing from example embodiments. Further, the various embodiments can be implemented as a method, apparatus or article of manufacture using standard programming and/or engineering techniques to produce software, firmware, hardware, or any combination thereof to control a computer to implement the disclosed subject matter. The term "article of manufacture" as used herein is intended to encompass a computer-readable (or machine-readable) device or computer-readable (or machine-readable) storage/communications media having a computer program stored thereon. For example, computer readable storage media can comprise, but are not limited to, magnetic storage devices (e.g., hard disk, floppy disk, magnetic strips), optical disks (e.g., compact disk (CD), digital versatile disk (DVD)), smart cards, and flash memory devices (e.g., card, stick, key drive). Of course, those skilled in the art will recognize many modifications can be made to this configuration without departing from the scope or spirit of the various embodiments.

In addition, the words "example" and "exemplary" are used herein to mean serving as an instance or illustration. Any embodiment or design described herein as "example" or "exemplary" is not necessarily to be construed as preferred or advantageous over other embodiments or designs. Rather, use of the word example or exemplary is intended to present concepts in a concrete fashion. As used in this application, the term "or" is intended to mean an inclusive "or" rather than an exclusive "or". That is, unless specified otherwise or clear from context, "X employs A or B" is intended to mean any of the natural inclusive permutations. That is, if X employs A; X employs B; or X employs both A and B, then "X employs A or B" is satisfied under any of the foregoing instances. In addition, the articles "a" and "an" as used in this application and the appended claims should generally be construed to mean "one or more" unless specified otherwise or clear from context to be directed to a singular form.

Embodiments described herein can be exploited in substantially any wireless communication technology, comprising, but not limited to, wireless fidelity (Wi-Fi), global system for mobile communications (GSM), universal mobile telecommunications system (UMTS), worldwide interoperability for microwave access (WiMAX), enhanced general packet radio service (enhanced GPRS), third generation partnership project (3GPP) long term evolution (LTE), third generation partnership project 2 (3GPP2) ultra mobile broadband (UMB), high speed packet access (HSPA), Z-Wave, Zigbee and other 802.XX wireless technologies and/or legacy telecommunication technologies.

A mattress of this disclosure is characterized by including air cells that are located on both sides of a user, characterized in that the air cells each have a convex shape on a first side surface, and the air cells are arranged so that the convex shapes thereof are respectively located near shoulder blade outer edges of the user.

A mattress of this disclosure is characterized by including air cells that are located on both sides of a user, characterized in that, in a plan view of the mattress, the air cells are arranged in a V-shape so as to extend from a central part of the mattress toward the outer side and extend along shoulder blade outer edges of the user.

A sheet of this disclosure is a sheet that has multiple spaces and constitutes air cells by feeding the air to the spaces, characterized in that the sheet is placed above or below a mattress, the air cells are located on both sides of a user of the mattress, the air cells each have a convex shape on a first side surface, and the air cells are arranged so that the convex shapes thereof are respectively located near shoulder blade outer edges of the user.

A system of this disclosure is a bed system characterized by including a bed body and an air cell that is provided between the bed body and a user, characterized in that the air cell has a convex shape on a first side surface, and the air cell is disposed so that the convex shape thereof is located near a shoulder blade outer edge of the user.

An air cell of this disclosure is an air cell that is provided between a bed body and a user, characterized in that the air cell has a convex shape on a first side surface, and the air cell is formed so that the convex shape is located at a position in contact with a line, extending from a side of a lumbar spine of the user to a shoulder blade outer edge of the user, when provided between the bed body and the user.

Hereinbelow, an embodiment for carrying out this disclosure is described with reference to the drawings. Note that, the following embodiment is an example for explaining this disclosure, and the technical scope of this disclosure described in the scope of claims is not limited to the following description.

Heretofore, in order to prevent bed sores of a user, there has been a mattress that is provided with sub-air cells for body position change (such sub-air cells for body position change are hereinafter referred to as "sub-cells"). The existing sub-air cells are cylindrical air cells that are arranged on both sides (e.g., at the shoulders, knees, waist, and buttocks) of the user.

For example, the sub-cells are arranged below the mattress in a direction parallel with the longitudinal direction of a mattress. By inflating these sub-cells, the mattress located above the sub-cells is raised. Thereby, the mattress and the sub-cells can support the user by bearing the load of the body of the user. However, a portion of the mattress which is raised by the inflation of the sub-cells and a portion of the raised portion which is brought into contact with the body of the user lying on the mattress are actually limited.

In the case of changing the body position of the user by inflating and deflating these sub-cells alternately, the mattress can support the user only partially. Hence, their contact area is small, thus causing an increase of body pressure.

In addition, since their contact area is small and thus the mattress supports only a small portion of the user's body, the user's body becomes unstable. Accordingly, this method has a problem in that the user's muscles contract and this hampers the user's sound sleep. In particular, such user's muscle tone also induces another risk of facilitating contracture of the user.

In order to solve these problems, a mattress and the like are described below based on a detailed embodiment. Note that, the following embodiment is an example of this disclosure, and this disclosure is not limited to the contents of this embodiment.

1. OVERALL CONFIGURATION

Figure 1B:
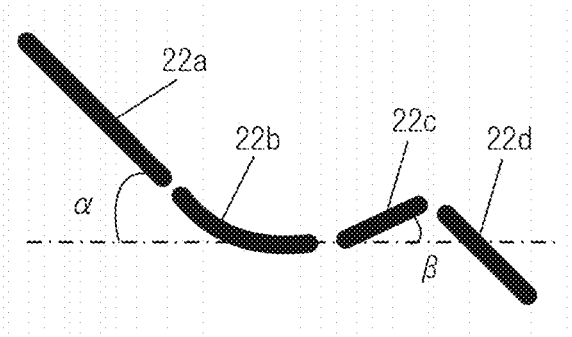
FIG. 1B is a diagram illustrating the configuration of a section of a bed apparatus in an embodiment of this disclosure.
Figure 1C:
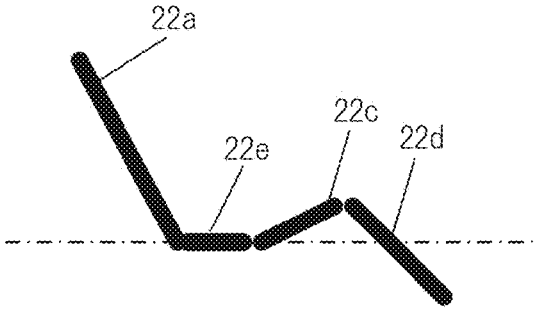
FIG. 1C is a diagram illustrating the configuration of a section of a bed apparatus in another embodiment of this disclosure.

FIGS. 1A-C are diagrams schematically illustrating a bed system 1 in this embodiment. As illustrated in FIG. 1A, in the bed system 1, a mattress 10 is placed on a bed body 20 which is a bed apparatus.

Note that, in this embodiment, the mattress 10 is an air mattress formed of air cells. Instead of the air mattress, the mattress 10 may be a urethane mattress or a hybrid type mattress obtained by combining urethane and air cells, for example. Alternatively, the mattress 10 may be an elastic body used for bedclothing such as a polyester fiber structure, gel, and spring.

The bed system 1 is used by a user P. For example, when the user P lies on the bed body 20 (the mattress 10), the head side is on the left side of FIG. 1A, whereas the foot side is on the right side thereof. In addition, under the assumption that the user P is of a normal size, the back of the user P is located at the position of a back section, and the waist of the user is located at the position of a curved section or a seat section. Specifically, in the case of a normal user, the greater trochanters are located approximately 980 mm from a foot side end part of the mattress 10 (the bed body 20).

Here, the user indicates, among persons using the bed system, a person actually using the bed apparatus (mattress), for example. The user indicates a patient or a person who needs to be cared for in a hospital or facility, or a person who is lying on the bed apparatus (mattress) in a house, for example.

In addition, in this embodiment, a staff indicates a person who supports the user. For example, the staff includes a doctor and a nurse in a hospital, a nursing care staff in a facility, a family member of the user in a house, and the like.

Further, in this embodiment, an operator indicates a person who manipulates the bed system. The operator is mainly the staff, but also includes the user when the user manipulates the bed system.

Under the assumption of a normal-sized user (with a height of around 140 to 170 cm), the typical bed body 20 has dimensions of 910 mm in the width direction which is the lateral direction and 1910 mm in the length direction which is the longitudinal direction. This size of the bed body is an example for explaining the embodiment, and the bed body may be a more compact mini size body (1800 mm in the length direction of the bed body) or may be a larger long size (e.g., 2050 mm in the length direction of the bed body), for example. In addition, if the size of the bed body 20 changes, the position of the user relative to the bed body also changes.

The locations (positions) of portions of the user change according to the size of the bed body 20 or the mattress 10. The position of the user observed when the size of the bed body 20 (the mattress 10) changes can be easily understood by those skilled in the art based on the contents of this disclosure.

In addition, the body position of the user in this embodiment includes the position of the user and the posture of the user. The position of the user indicates the position of the user on the mattress 10 (sleeping position). The posture of the user indicates the posture of the user observed when the user is sleeping on the mattress 10 (sleeping posture). Further, the body position may include the posture of the user observed when the user is not sleeping, such as a sitting position with his/her soles of feet on the floor and a long sitting position.

2. CONFIGURATION OF BED BODY

The configuration of the bed body 20 is described with reference to FIGS. 1A-2.

The bed body 20 includes a section 22, an upper frame 24, and a lower frame 26 as viewed from an upper side, and has an elevating mechanism 28 between the upper frame 24 and the lower frame 26.

As illustrated in FIG. 1B, the section 22 has, as viewed from the head side to the foot side when the user lies on the bed body 20, a back section 22*a*, a curved section 22*b* as the seat section, an upper leg section 22*c*, and a lower leg section 22*d*. Here, these sections of the section 22 are capable of turning by itself or in conjunction with each other.

Note that, the curved section 22*b* is a part of the seat section and can support the user by curving along with an elevation of the back section 22*a*. Alternatively, the curved section 22*b* may have such a structure that it extends or contracts while curving along with an elevation/lowering of the back section 22*a*. Here, the curved section has already been put on the market by the applicant as Kyma Line Bottom (Kyma Bottom).

In addition, for example, the back section 22*a* has a length (a length horizontal to the longitudinal direction of the bed body 20) of approximately 640 mm, the curved section 22*b* has a length of approximately 340 mm, the upper leg section 22*c* has a length of approximately 375 mm, and the lower leg section 22*d* has a length of approximately 555 mm.

Each section is connected to a driving device (actuator), for example. The section 22 is turnable by the operation of the driving device. Note that, by using a link mechanism for example, a single driving device can operate multiple sections of the section 22 without connecting driving devices to the respective sections. In addition, by joining the adjacent sections to each other, the sections of the section 22 operate in conjunction with each other.

Meanwhile, by turning the sections, the bed body 20 implements operations such as a back raising operation, an upper leg raising operation, and a lower leg lowering operation. The bed body 20 may further cause the back raising operation and the upper leg raising operation (lower leg lowering operation) to be performed in conjunction with each other.

As illustrated in FIG. 1B, the bed body 20 implements the back raising operation in such a way that the back section 22*a* is turned and elevated around its curved section 22*b* side. An angle α by which the back section 22*a* is raised (an angle α by which the back section 22*a* is elevated above a horizontal plane) at this time is referred to as a back raising angle α.

In addition, when the back section 22*a* is elevated, the curved section 22*b* curves in conjunction with the back section 22*a*. The curved section 22*b* can support the user by curving and conforming to the waist of the user. The back section 22*a* and the curved section 22*b* are joined to each other via their respective joints, for example.

Further, the bed body 20 implements the upper leg raising operation in such a way that the upper leg section 22*c* is turned around its end part on the curved section 22*b* side. An angle β by which the upper leg section 22*c* is raised (an angle β by which the upper leg section 22*c* is raised above the horizontal plane) at this time is referred to as an upper leg raising angle β.

Note that, the lower leg section 22*d* may operate in conjunction with the movement of the upper leg section 22*c*. In this case, a lower leg raising angle (a lower leg lowering angle) may be used instead of the upper leg raising angle.

Note that, as illustrated in FIG. 1C, the bed body 20 may be constituted of a seat section 22*e* instead of the curved section 22*b*. In this case, for example, the back section 22*a* has a length of approximately 785 mm and the seat section 22*e* has a length of approximately 195 mm. The seat section 22*e* typically does not turn and supports a waist part (buttocks) of the user.

The section 22 is supported by the upper frame 24. The upper frame 24 may have any shape as long as it can support the section 22. Further, the lower frame 26 may have any shape as long as it can support the upper frame 24 supporting the section 22.

The elevating mechanism 28 is for adjusting the height of the upper frame 24 and configured to adjust the height of the bed body 20. Here, the height of the bed body 20 typically indicates the height from an installed surface (ground surface) to the upper frame 24 (floor height). Note that, the height of the bed body 20 may be the height from the ground surface to the section 22.

The elevating mechanism 28 is implemented by a link mechanism or a driving device (driving mechanism) such as an actuator, for example.

Figure 2:
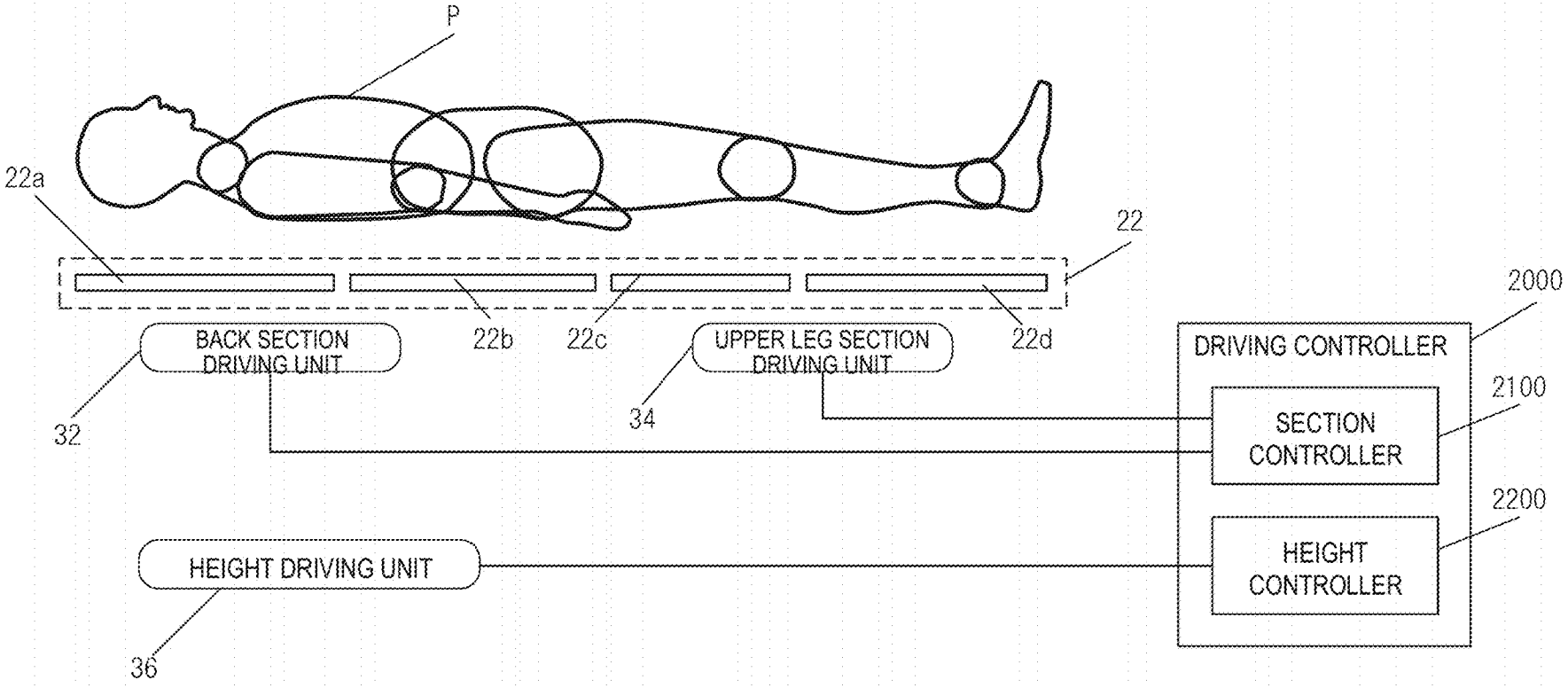
FIG. 2 is a diagram illustrating an operation of a bed apparatus in an embodiment of this disclosure.

FIG. 2 is a diagram illustrating the operation of the bed body 20. The bed body 20 has driving units for driving the respective sections.

A back section driving unit 32 is capable of elevating the back section 22*a*. For example, the back section driving unit 32 is an actuator, and the back section 22*a* is connected to a rod end of this actuator via a link mechanism.

An upper leg section driving unit 34 is capable of elevating the upper leg section 22*c*. For example, the upper leg section driving unit 34 is an actuator, and the upper leg section 22*c* is connected to a rod end of this actuator via a link mechanism.

In addition, the driving units are connected to a driving control unit 2000. The driving control unit 2000 functions as a section control unit 2100 that is configured to control the back section driving unit 32 and the upper leg section driving unit 34 and as a height control unit 2200 that is configured to control a height driving unit 36.

The section control unit 2100 implements a back raising function and is configured to elevate the back section 22*a* by controlling the back section driving unit 32. Specifically, the section control unit 2100 advances the rod of the actuator which is an example of the back section driving unit 32. In response to the advance of the rod of the actuator, the back section driving unit 32 applies its driving force to the back section 22*a* via the link mechanism. With the application of the driving force, the back section 22*a* turns with the foot side of the back section 22*a* as its fulcrum to thereby elevate its head side.

At this time, the curved section 22*b* joined to the back section 22*a* is also elevated. For example, one end side of the curved section 22*b* is joined to the back section 22*a* whereas the other end side thereof is joined to the upper frame 24. In addition, the curved section 22*b* is capable of curving, and may be elevated at its end part on the back section 22*a* side along with the elevation of the back section 22*a*. Further, the curved section 22*b* may be configured to be extendable and contractible.

The section control unit 2100 implements an upper leg raising function and is configured to elevate the upper leg section 22*c* by controlling the upper leg section driving unit 34. Specifically, the section control unit 2100 advances the rod of the actuator which is an example of the upper leg section driving unit 34. In response to the advance of the rod of the actuator, the upper leg section driving unit 34 applies its driving force to the upper leg section 22*c* via the link mechanism. With the application of the driving force, the upper leg section 22*c* turns with the curved section 22*b* side of the upper leg section 22*c* as its fulcrum to thereby elevate its lower leg section 22*d* side.

At this time, the lower leg section 22*d* may turn in conjunction with the upper leg section 22*c*. For example, when the lower leg section 22*d* is connected to the upper leg section 22*c* via the link mechanism, the lower leg section 22*d* is elevated at its one end on the upper leg section 22*d* side along with the elevation of the upper leg section 22*c* on the lower leg section 22*d* side. Along with the elevation of one end of the lower leg section 22*d*, the other end thereof located on the foot side of the bed body 20 is lowered. At this time, the other end of the lower leg section 22*d* is lowered below the upper frame 24, but may be joined to the upper frame 24 instead.

Meanwhile, the height control unit 2200 implements a function of elevating and lowering the bed body 20 and is configured to increase or decrease the height of the upper frame 24 by controlling the height driving unit 36.

For example, the height driving unit 36 is provided between the upper frame 24 and the lower frame 26, and one end of an actuator which is an example of the height driving unit 36 is provided to the lower frame 26. In response to an advance of a rod of this actuator, the height driving unit 36 pushes up and elevates the upper frame 24 via the link mechanism. Thereby, the floor height of the bed body 20 increases.

Note that, the driving units perform operations opposite from the above operations if the driving control unit 2000 controls the driving units so that the units perform the opposite operations. In other words, by retracting the rod of the actuator, the driving units perform operations such as a back lowering operation, an upper leg lowering operation, and a floor height lowering operation.

3. CONFIGURATION OF MATTRESS

Figure 3:
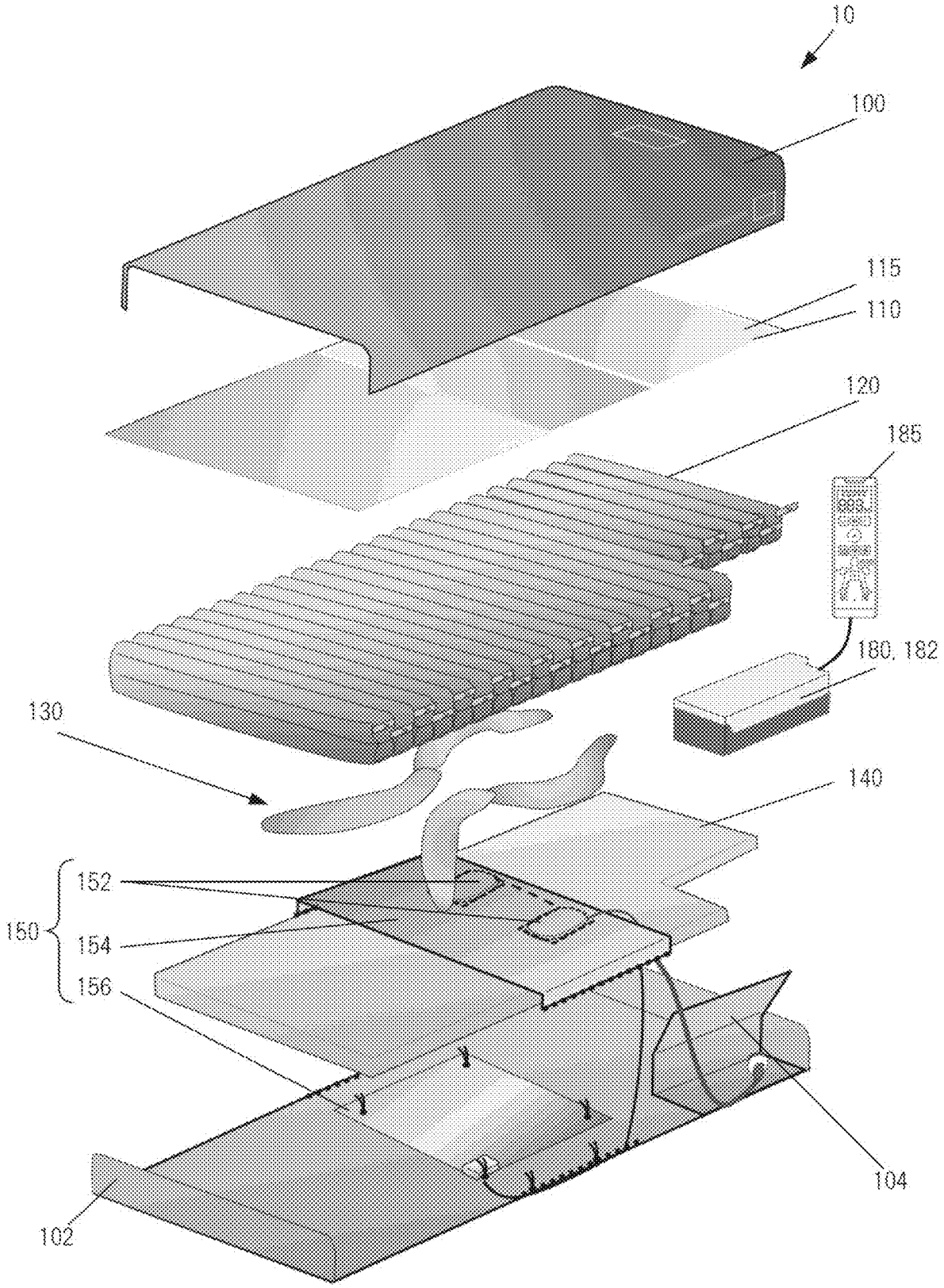
FIG. 3 is a view illustrating the configuration of a mattress in an embodiment of this disclosure.

The configuration of the mattress 10 is described. FIG. 3 is an exploded view schematically illustrating the configuration of the mattress 10.

The mattress 10 is wholly covered with covers (a top cover 100 and a bottom cover 102). The top cover 100 and the bottom cover 102 are configured to be attachable and detachable. Here, the top cover 100 and the bottom cover 102 may be formed integrally.

In addition, the mattress 10 includes, inside the covers, a top urethane 110, a main cell 120, a sub-cell 130, and a bottom cushion 140 in the order from an upper layer.

The top urethane 110 is placed on air cells and constituted of a urethane sheet, for example. In addition, a glide sheet 115 is provided between the top urethane 110 and the top cover 100 which is a surface fabric. The glide sheet 115 is made of a low frictional resistance material and provided for making the top cover 100 and the top urethane 110 easy to slip against each other. Note that, the glide sheet 115 may be provided as needed.

The main cell 120 is constituted of an air cell group formed of multiple air cells. The main cell 120 is connected to a pump 180 via an air feed tube (not illustrated). The main cell 120 is sometimes also referred to as a body cell.

The pump 180 is connected to each of the air cells. For example, the pump 180 is connected by dividing the cells, constituting the main cell 120, into one or multiple lines (groups) and connecting air feed tubes to these lines, respectively. Then, the air is fed from the pump 180 to the main cell 120 to inflate the main cell 120. Besides, by releasing valves provided between the pump 180 and the main cell 120 or forcibly discharging the air, it is possible to discharge the air from the main cell 120 and deflate the main cell 120.

In addition, the pump 180 is also connected to the sub-air cell (sub-cell) 130. As in the manner described above, the pump 180 is capable of feeding the air to the sub-cell 130 and discharging the air (releasing valves or forcibly discharging the air).

Meanwhile, the pump may be housed in a pump housing compartment in the mattress 10. For example, in FIG. 3, a compartment 104 for housing the pump is provided at or near a corner part of the mattress 10. Here, the compartment 104 is provided with a pump cover. By providing the pump part in one compartment of the mattress 10 in this manner, it is possible to make the pump part united with the mattress 10.

Note that, the pump 180 may be provided separately from the mattress 10. In this case, no compartment for housing the pump 180 has to be provided in the mattress 10.

In addition, the pump 180 may be provided integrally with a control device as a pump unit 182. The pump unit 182 includes the pump 180, the control device that is configured to control the pump 180, and a memory device that is configured to store information and programs necessary for the operation. For example, the control device included in the pump unit 182 can control the operation of the pump 180 according to a signal input from a user interface device.

Here, the control device may include not only a control unit such as a CPU but also other control devices. For example, in the case where the pump 180 is a diaphragm pump or an electromagnetic pump, the control device may include an electromagnetic valve that is configured to control the pump and a driving circuit and a driver circuit that are configured to control them, for example.

In addition, a user interface panel 185 may be connected as an example of the user interface device. To put it differently, the user interface panel 185 is a device that is configured to output a manipulation signal to the control device.

Note that, the control device that controls the pump 180 may be provided in any device. Although the control device is provided integrally with the pump as the pump unit 182 in this embodiment, the user interface panel 185 may have a function of the control device instead, for example.

The sub-cell 130 is an air cell that is used to change the body position of the user and support the body of the user. The sub-cell 130 is sometimes also referred to as a support cell, a body position changing cell, or an SF cell. Although the sub-cell 130 is disposed below the main cell 120 in this embodiment, the sub-cell may be disposed above the main cell 120 or disposed below the bottom cushion 140.

The bottom cushion 140 is a support member that is disposed below the main cell 120. For example, the bottom cushion 140 is made of a member such as urethane or hard cotton. This bottom cushion 140 is provided with a sensor 150 that is configured to detect the sleeping position of the user and the like.

The sensor 150 is a sensor using a capacitance sensor. The sensor 150 has a positive electrode 152 and a GND sheet 156 to which a case housing a GND substrate is attached. The GND sheet 156 may also function as a ground (GND) electrode.

In addition, the sensor may be provided with a sensor cover 154 in order to dispose the positive electrode 152 above the bottom cushion 140. For example, the sensor cover 154 has a shape capable of housing the positive electrode 152, such as a pocket. By housing the positive electrode 152 in the pocket of the sensor cover 154, it is possible to position the positive electrode 152 relative to the mattress 10.

Note that, the sensor cover 154 is a waterproof cover for securing the positive electrode 152 to the bottom cushion 140 (or a cover of the bottom cushion). Here, for example, other methods may be used to secure the positive electrode 152 as long as it can position the positive electrode 152 relative to the mattress 10. For example, as a method for positioning the positive electrode 152, a member for securing the positive electrode 152 may be provided to the bottom cushion 140, or a recess for housing the positive electrode 152 may be formed in the bottom cushion. Alternatively, the bottom cushion 140 and the positive electrode 152 may be formed integrally so that the positive electrode is immovable relative to the bottom cushion.

In addition, the positive electrode 152 is a member housing a substrate, and is housed in an oblong case in this disclosure. The positive electrode 152 is formed by attaching a conductive sheet on the back side (on the side which is brought into contact with the bottom cushion 140 located below the positive electrode when the positive electrode is installed).

The positive electrode 152 may have other shapes. For example, the positive electrode 152 may have any of a round shape, an oval shape, a rectangular shape (e.g., a rectangle and a square), and a polygonal shape. In addition, the positive electrode 152 is provided with the conductive sheet on the back side thereof. Here, the conductive sheet may be formed to cover the entire backside of the positive electrode 152, or alternatively formed to cover a part of the positive electrode 152.

Further, the positive electrode 152 and the GND sheet 156 sandwich the bottom cushion 140 therebetween. Here, the whole or a part of the GND sheet 156 has a function of a conductive sheet. In other words, the whole GND sheet 156 may be made of a material functioning as a conductive sheet (e.g., a sheet having a conductive ink printed thereon or a sheet made of a conductive fiber), or alternatively, the GND sheet 156 may be formed by attaching or embedding a conductive sheet to or in a part of a sheet made of a certain material.

Here, the bottom cushion 140 is deformed when the user rides on the mattress 10. When the bottom cushion 140 is deformed, the distance between the positive electrode 152 and the GND sheet 156 changes and thus the capacitance also changes. This change of the capacitance is acquired by a judgment unit 1010 to be described later, whereby the body position and the location of the user can be acquired.

Note that, the bottom cover 102 may have an opening (e.g., an opening having a fastener) for the sensor 150 so that the sensor 150 is easily accessible through this opening.

In addition, the positive electrode 152 may be disposed near the buttocks of the user, for example. To put it differently, the positive electrode may be disposed at a position above the seat section 22*e* or near the foot side of the curved section 22*b*. Further, although two left and right positive electrodes are provided as the positive electrode 152 in this embodiment, the number of the positive electrodes 152 may be one, or may be three or more.

4. CONFIGURATION OF CELL

[4.1 Configurations of Main Cell and Sub-Cell]

Next, the configuration of each cell (the main cell 120 and the sub-cell 130) is described with reference to FIG. 4.

The main cell 120 is divided into one or multiple lines, and connected to the pump 180 via air feed tubes. For example, in FIG. 4, the main cell 120 is connected to the pump 180 while being divided into lines A to C. Specifically, the pump 180 feeds the air to and/or discharge the air from cells 120A through an air feed tube 184. The cells 120A are connected to the line A, and their pressure changes like those of other cells of the line A do.

The pump 180 is capable of switching the line to and/or from which the air is fed and/or discharged by means of switching valves, for example. The pump 180 may feed and/or discharge the air by switching the line sequentially from one line to another, or alternatively may feed and/or discharge the air to/from all the lines by making the lines communicate with each other. In addition, air feed tubes may be connected from the pump 180 to the lines respectively or alternatively to all the air cells, respectively.

Figure 4:
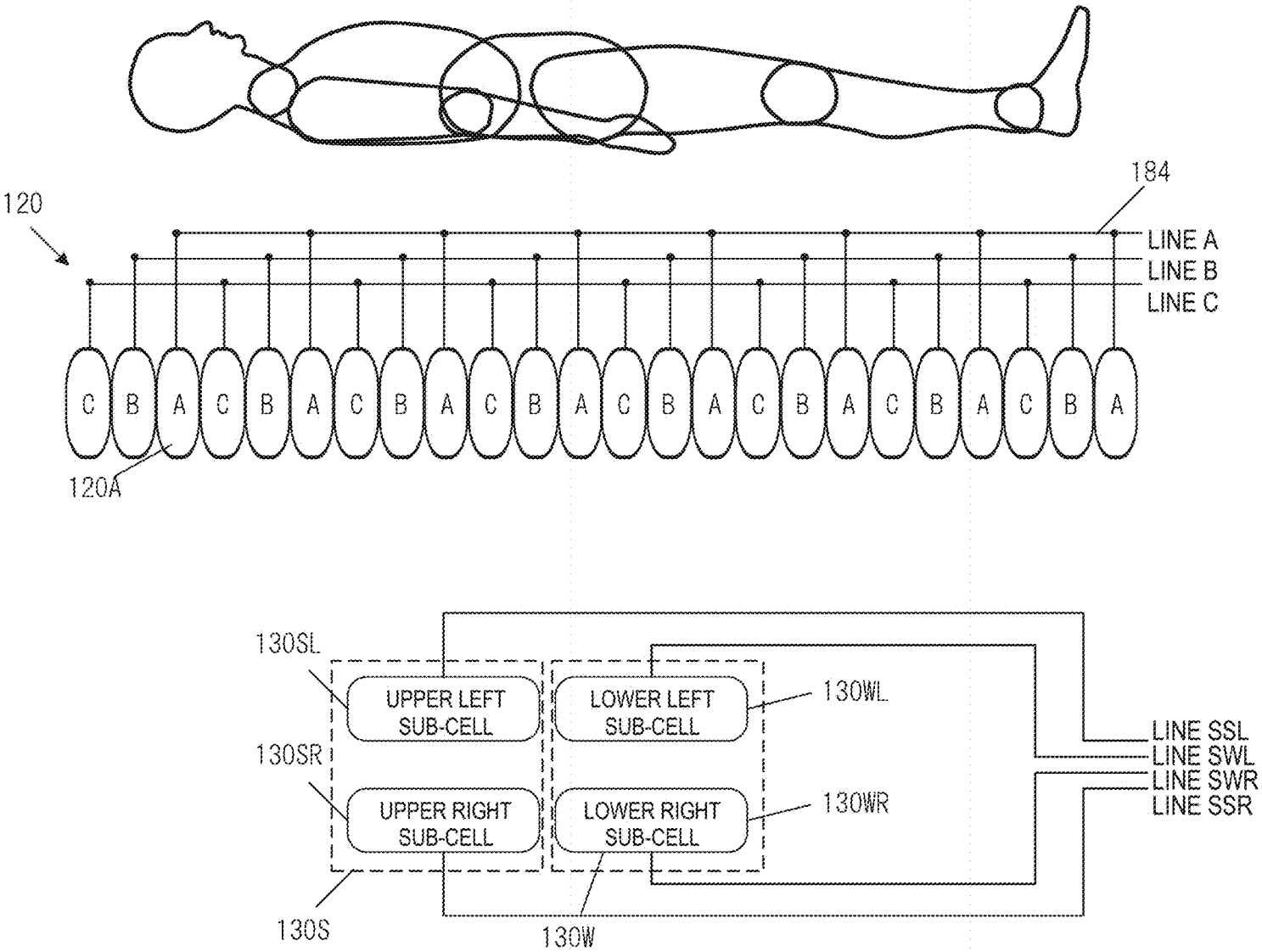
FIG. 4 is a diagram illustrating the configuration of air cells in the embodiment of this disclosure.

Further, although the main cell is divided into the three lines A to C in FIG. 4, it may be divided into another number of lines. The main cell is preferably divided into multiple lines. Alternatively, a part of the main cell may be defined as a separate line. For example, the pump 180 may feed the air to and/or discharge the air from only the head side or the foot side of the user P which is defined as a separate line. Still alternatively, the entire main cell 120 may be defined as the same line.

The sub-cell 130 includes an upper sub-cell 130S which is designed to mainly support the upper half (the shoulders) of the user P and a lower sub-cell 130W which is designed to mainly support the lower half (the waist and thighs) of the user P.

In addition, the sub-cell 130 is disposed on the left and right of the user P. The upper sub-cell 130S includes an upper left sub-cell 130SL which is located on the left side when the user is in a supine position and an upper right sub-cell 130SR. Meanwhile, the lower sub-cell 130W includes a lower left sub-cell 130WL which is located on the left side when the user is in a supine position and a lower right sub-cell 130WR.

Further, the sub-cell 130 is connected to the pump 180 through separate lines from those of the main cell 120. For example, the sub-cell has a line SSL through which the air is fed to and/or discharged from the upper left sub-cell 130SL, a line SWL through which the air is fed to and/or discharged from the lower left sub-cell 130WL, a line SSR through which the air is fed to and/or discharged from the upper right sub-cell 130SR, and a line SWR through which the air is fed to and/or discharged from the lower right sub-cell 130WR. The pump 180 may be connected to these sub-cells 130 through air feed tubes respectively, or alternatively may switch the sub-cell 130 to and/or from which the air is fed and/or discharged by means of switching valves.

Note that, these lines of the sub-cell 130 may be provided as different lines. For example, in the sub-cell 130, the sub-cells which are located diagonally opposite each other, such as the upper left sub-cell 130SL and the lower right sub-cell 130WR, may be set as the same line. Alternatively, in the sub-cell 130, the sub-cells which are located on the same (left or right) side, such as the upper left sub-cell 130SL and the lower left sub-cell 130WL, may be set as the same line.

In addition, the pump 180 may be connected to the lines, to and/or from which the air is fed and/or discharged, through air feed tubes respectively and feed the air to and/or discharge the air from these lines respectively, or alternatively may feed and/or discharge the air by switching the line using switching valves. Alternatively, the pump 180 may be connected using air feed tubes and switching valves in combination.

Further, the pump 180 may be constituted of one pump or may be constituted of multiple pumps.

[4.2 Structure of Sub-Cell]

Figure 5:
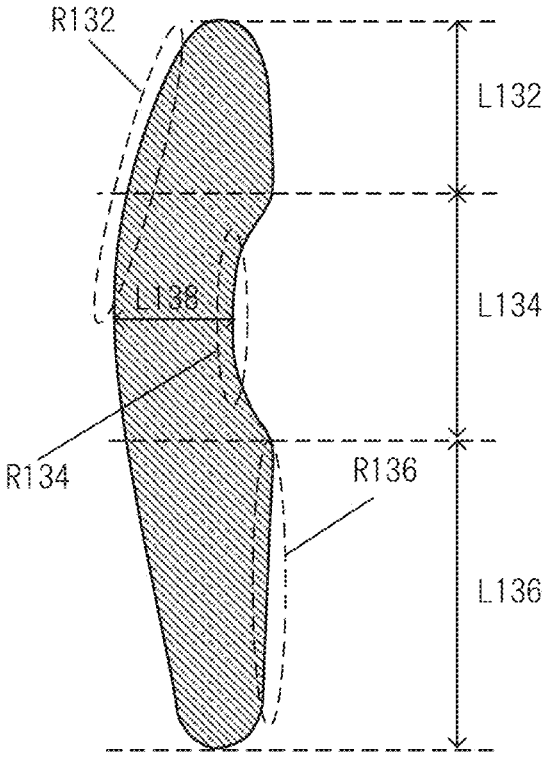
FIG. 5 is a diagram illustrating the configuration of a sub-air cell in the embodiment of this disclosure.

The structure of the sub-cell is described. FIG. 5 is a plan view of the shape of the sub-cell 130.

As illustrated in FIG. 5, the sub-cell 130 has a curved shape (for example, an R-shape as a curved shape) at its side part. For example, a region R132 has a curved shape (R-shape) formed on the outer side of the sub-cell 130 (a first side surface located on the left side of FIG. 5). This R-shape preferably has a curvature radius R of 450 mm to 500 mm, and a curvature radius R of 486 mm in FIG. 5.

In addition, the sub-cell 130 is formed in such a way that, when it is disposed on the mattress 10, the R-shape of its region R132 extends along a line from a side of the user's lumbar spine (lumbar spine side) toward an outer edge of the user's shoulder blade (shoulder blade outer edge). The sub-cell can support the user by being disposed in such a way that this R-shape is located approximately near the user's shoulder blade outer edge. Note that, the term "shoulder blade outer side" indicates sides of the shoulder blade located on the left and right outer sides of the user's body. Meanwhile, the term "near" indicates an approximate range, and indicates that, for most of the users, the sub-cell 130 is located within a range in contact with the outer edge of the user's shoulder blade.

Meanwhile, the inner side of the sub-cell 130 (a second side surface located on the right side of FIG. 5) has a concave R-shape. For example, a region R134 is formed slightly above the center of the sub-cell 130. This concave R-shape has a length (L134 in FIG. 5) of 304 mm, and is formed at a position 153 mm (L132 in FIG. 5) below the top and 293 mm (L136 in FIG. 5) above the bottom, for example. Besides, the most recessed portion of the sub-cell 130's concave shape has a width (L138 in FIG. 5) of 182 mm.

The sub-cell 130 is disposed on the mattress 10 in such a way that the R-shape of this region R134 supports the buttocks of the user. In other words, the sub-cell 130 can support the buttocks of the user by being disposed in such a way that the inner-side R-shape (concave R-shape) is located near the buttocks of the user. Here, the term "near" in the term "near the buttocks" indicates an approximate range, and indicates that, for most of the users, the sub-cell 130 is located within a range in contact with his/her buttocks.

Meanwhile, a lower region R136 on the inner side of the sub-cell 130 is substantially linear. The sub-cell 130 is disposed on the mattress 10 in such a way that the substantially linear shape on the inner side of this region R136 supports the thighs of the user. In other words, the sub-cell 130 has the region R134 supporting the buttocks of the user and the region R136 supporting the thighs of the user.

The dimensions described above are exemplary values for explaining the size of the sub-cell 130, and are not limited to these values. These sizes of the sub-cell 130 disclosed also fall within the equivalent range as long as such sizes enable the sub-cell 130 to bring about the effect of supporting the user.

For example, any length can be employed for the length L134 in FIG. 5 as long as the length is enough to support the buttocks of the user. The length L134 is preferably within a range of 240 mm to 320 mm. Meanwhile, any length can be employed for the length L136 in FIG. 5 as long as the length is enough to support the thighs of the user. The length L136 is preferably within a range of 150 mm to 360 mm.

By disposing this sub-cell 130 while changing its direction in the top-to-bottom and left-to-right directions, the sub-cell 130 can support the user appropriately.

Figure 6A:
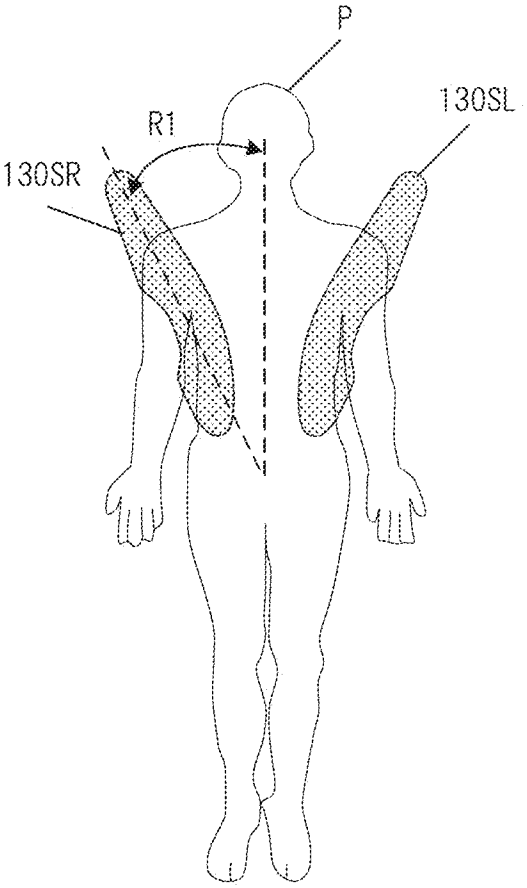
FIG. 6A is a diagram illustrating a layout of sub-air cells in an embodiment of this disclosure.

FIG. 6A is a diagram illustrating that the sub-cells 130 are arranged on the upper half of the body of the user. For example, the sub-cells 130 are arranged on the left side (on the right side in FIG. 6A) of the user P as the upper left sub-cell 130SL, and on the right side (on the left side in FIG. 6A) of the user P as the upper right sub-cell 130SR.

In FIG. 6A, the sub-cells 130 are arranged in a V-shape so as to extend from both sides of the user P's lumbar spine toward his/her shoulder blade outer edges. At this time, for example, the sub-cell 130 (the upper right sub-cell 130SR) is disposed so as to extend in a direction forming a predetermined angle R1 with respect to the center. For example, in the case of FIG. 6A, the angle R1 is approximately 22 degrees. This angle R1 is an angle suitable for the sub-cell to be disposed so as to extend along the outer side of the user's shoulder blade, and is preferably around 15 to 36 degrees. To put it differently, a protruding portion (convex portion) of the sub-cell forming the angle R1 is located near the shoulder blade outer edge.

In addition, the upper left sub-cell 130SL and the upper right sub-cell 130SR are arranged on the opposite left and right sides and have the same shape.

Further, the sub-cells 130 are arranged at such positions that, after the sub-cells have inflated, their height at both sides of the user's lumbar spine becomes the highest.

Figure 6B:
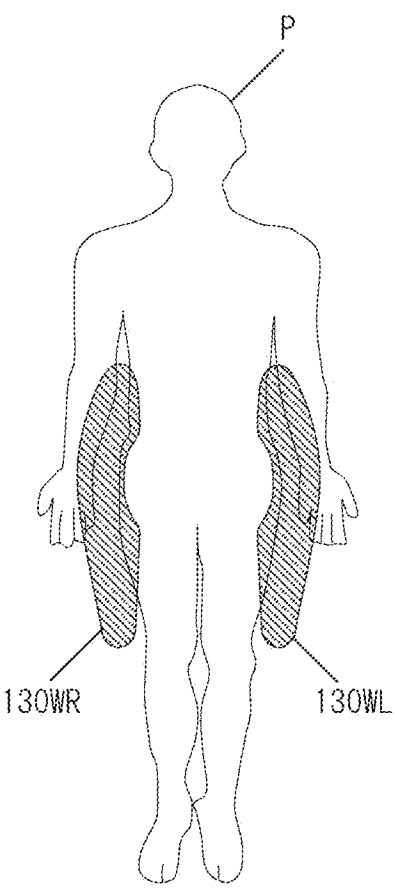
FIG. 6B is a diagram illustrating another layout of sub-air cells in an embodiment of this disclosure.

FIG. 6B is a diagram illustrating that the sub-cells 130 are arranged on the lower half of the body of the user. For example, the sub-cells 130 are arranged on the left side (on the right side in FIG. 6B) of the user P as the lower left sub-cell 130WL, and on the right side (on the left side in FIG. 6B) of the user P as the lower right sub-cell 130WR.

As illustrated in FIG. 6B, the sub-cells 130 have a curved shape so that they extend along the buttocks and thighs of the user when arranged on the lower half of the body of the user.

In addition, the concave portions on the inner side of the sub-cells 130 are located at positions surrounding the buttocks of the user and thereby support the buttocks of the user from both sides thereof. Meanwhile, the linear portions on the inner side of the sub-cells 130 extend along the thighs of the user and thereby support the thighs of the user from both sides thereof.

Here, the lower left sub-cell 130WL and the lower right sub-cell 130WR are arranged on the opposite left and right sides and have the same shape. Besides, they are arranged while being flipped vertically as compared to those in FIG. 6A.

In addition, the sub-cells 130 are arranged at such positions that, after the sub-cells have inflated, their height at both sides of the user's buttocks becomes the highest.

Figure 6C:
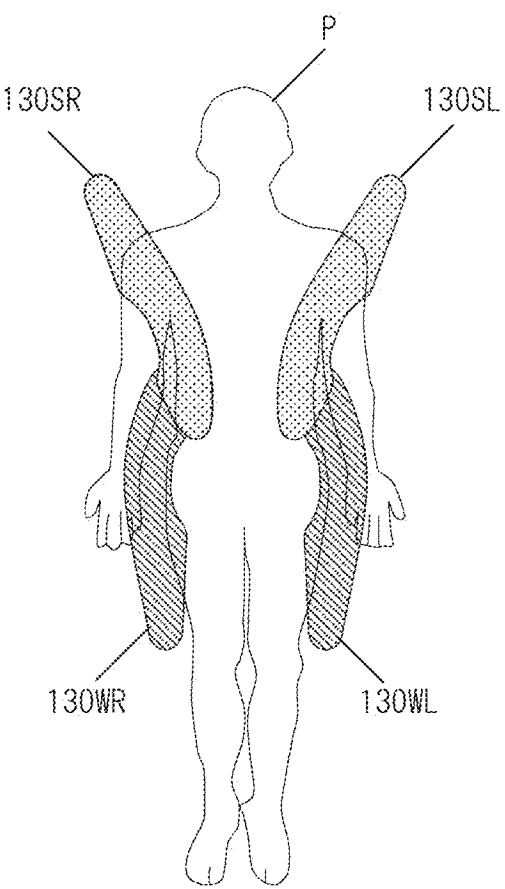
FIG. 6C is a diagram illustrating another layout of sub-air cells in an embodiment of this disclosure.

FIG. 6C is a schematic diagram in the case of arranging all the sub-cells. For the user P, the sub-cells 130 are arranged as the upper left sub-cell 130SL, the upper right sub-cell 130SR, the lower left sub-cell 130WL, and the lower right sub-cell 130WR.

In this manner, the sub-cells 130 are arranged at four positions of the mattress 10. By inflating and deflating these sub-cells 130 sequentially, it is possible to change the body position of the user and the like.

Note that, the upper-side sub-cell and the lower-side sub-cell may have different shapes. To put it differently, when the sub-cell is disposed on the upper half of the body of the user P, the sub-cell may have any shape as long as it has an outer R-shape (convex shape). For example, in FIG. 6A, the sub-cells 130 have a shape protruding outward from the user's shoulders in order that they have the same shape as those arranged on the lower half of the body of the user. Accordingly, the sub-cells 130 may have a shape extending to the shoulders and not protruding outward from the shoulders.

[4.3 Position of Sub-Cell]

Figure 7:
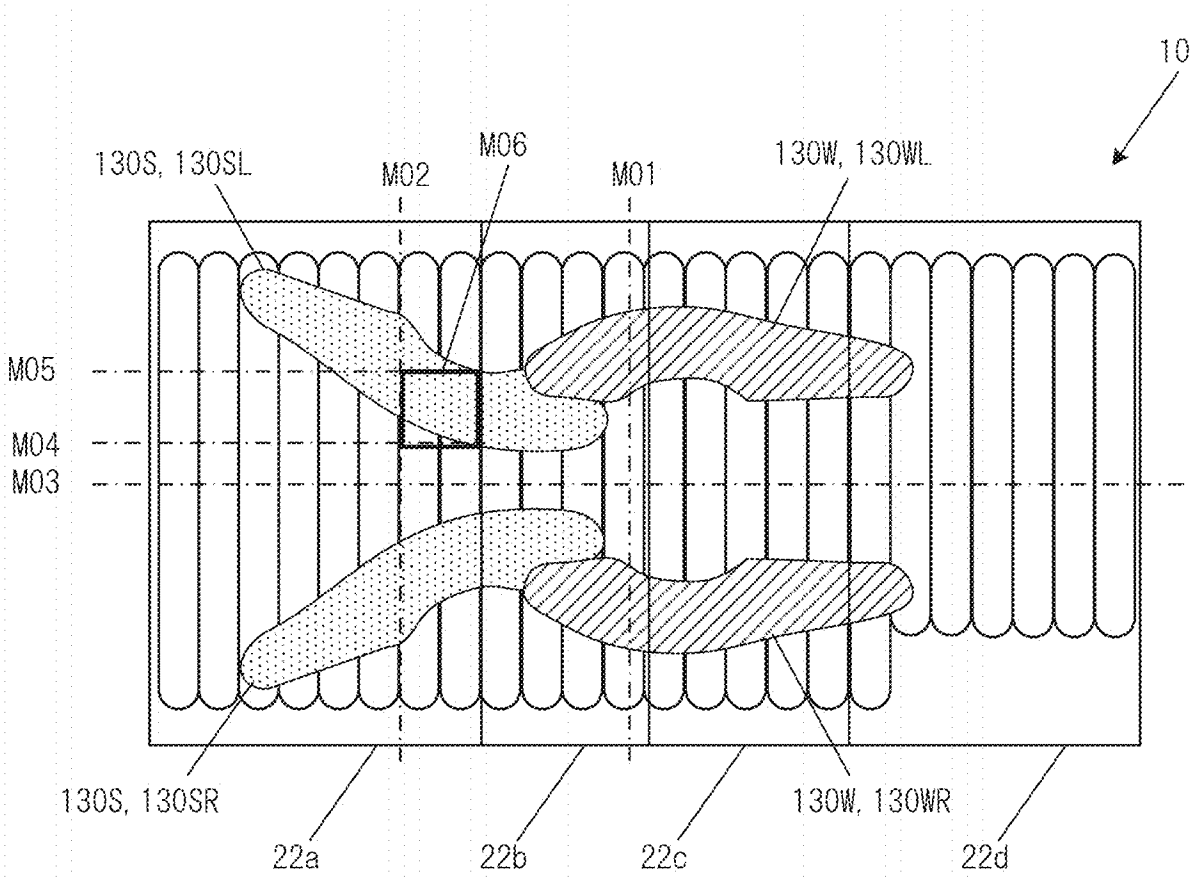
FIG. 7 is a diagram illustrating the positions of the sub-air cells in an embodiment of this disclosure.

FIG. 7 is an explanatory diagram of the positions of the sub-cell 130, the section 22, and the main cell. FIG. 7 is a top view of the mattress 10. The upper sub-cells 130S (the upper left sub-cell 130SL, the upper right sub-cell 130SR) arranged on the upper half of the body are arranged so as to extend mainly over a range from the back section 22*a* to the curved section 22*b*. Meanwhile, the lower sub-cells 130W (the lower left sub-cell 130WL, the lower right sub-cell 130WR) arranged on the lower half of the body are arranged so as to extend over the curved section 22*b*, the upper leg section 22*c*, and the lower leg section 22*d*.

Here, the sub-cells 130 (the upper left sub-cell 130SL, the upper right sub-cell 130SR) arranged on the upper half of the body are arranged in a V-shape so that the outer R-shapes of the sub-cells 130 (in FIG. 7, on the side thereof closer to the center of the mattress 10) extend from both sides of the user's lumbar spine toward his/her shoulder blade outer edges. In other words, in a plan view of the mattress 10 (the bed body 20), the sub-cells are arranged in a V-shape so as to extend from a central part of the mattress 10 obliquely toward the outer side (head-side corner parts) of the mattress.

Here, in the case where the bed body 20 has a dimension of 910 mm in its width direction, the region from both sides of the user's lumbar spine to his/her shoulder blades preferably has a dimension in its longitudinal direction that is 25 percent of the dimension of the back section 22*a* in its longitudinal direction, and has a dimension in its lateral direction that extends in the range from 12 percent to 45 percent with respect to the center of the mattress in its lateral direction.

Specifically, assuming that a position M01 of the greater trochanters of the user is 980 mm from the foot side end part in FIG. 7, a position M02 of the shoulder blades of the user is 465 mm from the greater trochanters. Accordingly, the R-shape (convex shape) of the sub-cell 130 is preferably included in the following range (a rectangular region M06).

One side of this region has a length from the shoulder blade position M02 to an end part of the back section 22*a* on the curved section 22*b* side (approximately 160 mm)

Other sides thereof have a length that extends in the range from the position of 12 percent (approximately 59 mm from the center (the length from M03 to M04)) to the position of 45 percent (approximately 148 mm (the length from M04 to M05)) with respect to the center of the mattress 10

Meanwhile, in the case of installing the sub-cell to the bed body 20 equipped with the seat section 22*e* instead of the curved section 22*b*, the region from both sides of the user's lumbar spine to his/her shoulder blades preferably has a dimension in its longitudinal direction that is 40 percent of the dimension of the back section 22*a* in its longitudinal direction, and has a dimension in its lateral direction that extends in the range from 12 percent to 45 percent with respect to the center of the mattress in its lateral direction.

In this case, the length from the shoulder blade position M02 of the back section to an end part of the back section 22*a* on the seat section 22*e* side is approximately 320 mm.

In addition, the lower sub-cells 130W are preferably arranged near the buttocks of the user. The lower sub-cells 130W are brought into contact with the user over the user's waist, buttocks, and thighs. The lower sub-cells 130W are arranged in such a way that their concave portions are located roughly in a region extending from the curved section 22*b* (or the seat section) to the upper leg section 22*c*. In this way, the concave portions are preferably arranged near the buttocks of the user.

5. FUNCTIONAL CONFIGURATION

Figure 8A:
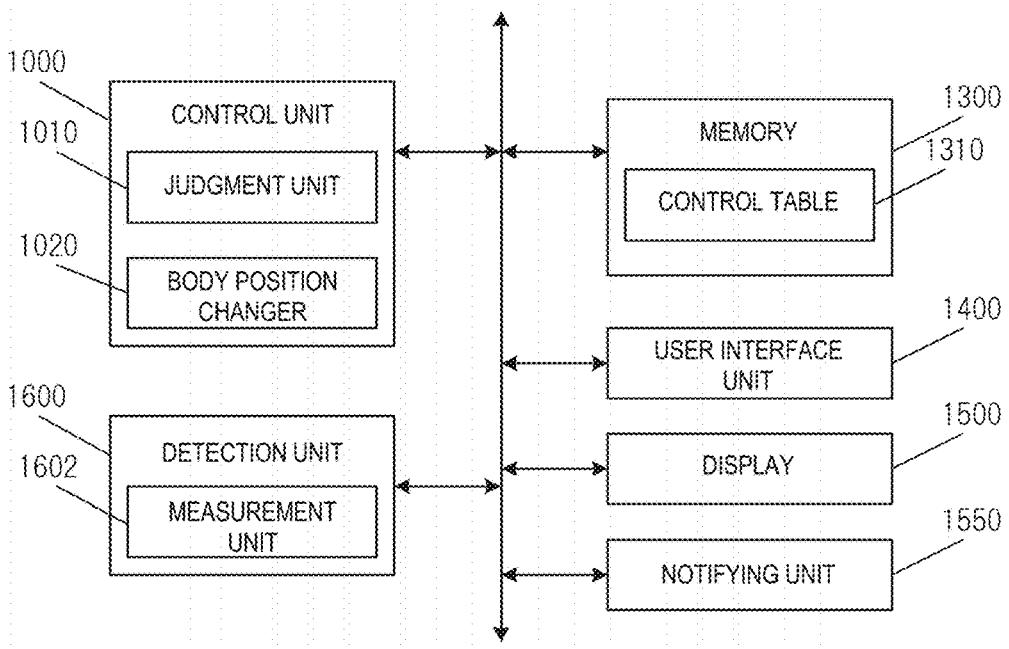
FIG. 8A is a diagram illustrating a functional configuration in the embodiment of this disclosure.
Figure 8B:
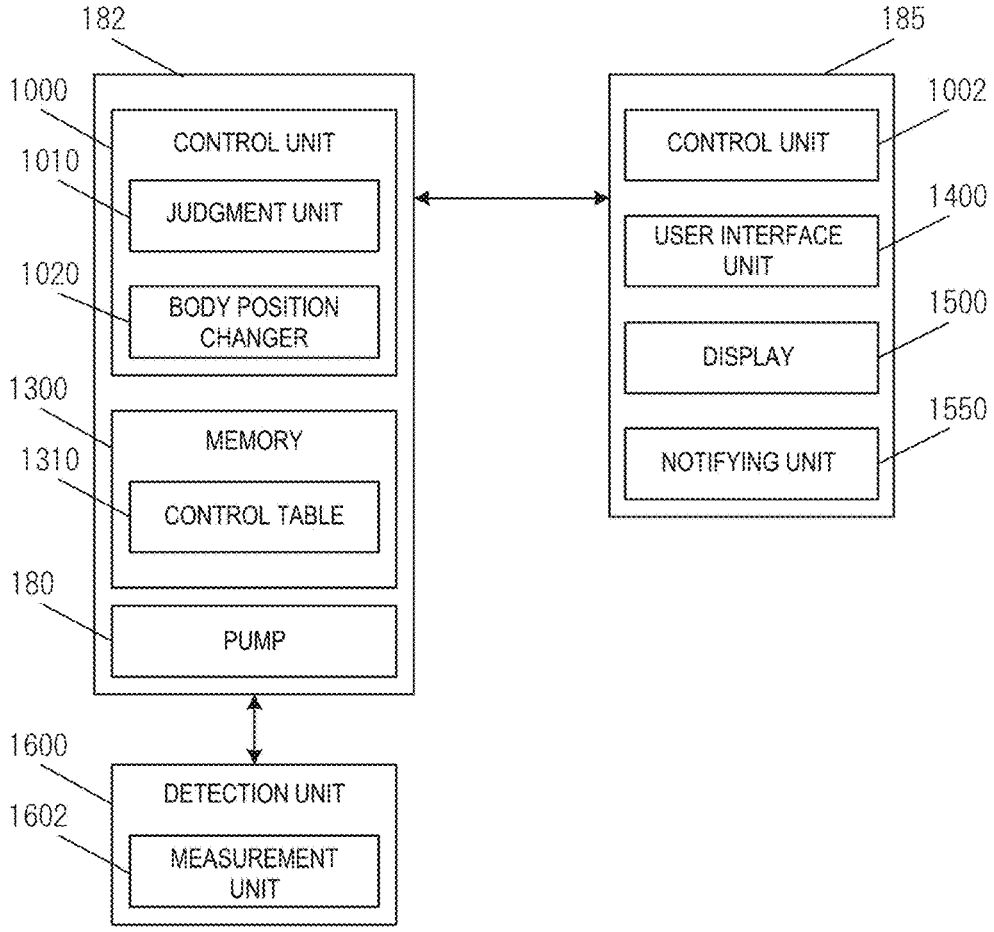
FIG. 8B is another diagram illustrating a functional configuration in the embodiment of this disclosure.

FIGS. 8A-B are diagrams illustrating the functional configuration of the bed system 1 (mattress 10). The functions illustrated in FIG. 8A are functions for controlling the mattress 10 and are implemented by the control device that controls the mattress 10. Note that, in the case where the bed body 20 and the mattress 10 operate in collaboration with each other, the functions illustrated in FIG. 8A may be implemented by the control device of the bed body 20.

The control unit 1000 is a functional unit for controlling the entire mattress 10. The control unit 1000 implements various functions by retrieving and executing various programs stored in a memory 1300, and is constituted of one or multiple arithmetic units (such as CPUs (Central Processing Units)), for example.

In addition, the control unit 1000 may also be capable of controlling the main cell 120 which is constituted of the air cells and the sub-cell 130. Here, the control unit 1000's control over the air cells indicates that it controls the pressure of the air cells. With a change of the pressure of the air cells, the air cells inflate or deflate. To put it differently, the control unit 1000 is capable of controlling the size (the degree of inflation) of the air cells.

For example, the control unit 1000's control over the size of the air cells mentioned above indicates that it feeds the air to and discharges the air from the air cells by controlling the pump 180 to thereby perform control to increase and decrease the pressure of the air cells. When decreasing the pressure of the air cells, the control unit 1000 may discharge the air by releasing valves or alternatively may forcibly discharge the air by controlling the pump 180.

In addition, the control unit 1000 may function as the judgment unit 1010 and a body position changer 1020 by retrieving and executing programs from the memory 1300.

The judgment unit 1010 is configured to judge the state of the user based on information measured by a measurement unit 1602 and information detected by a detection unit 1600.

The judgment unit 1010 is capable of judging, as the state of the user, whether or not the user is on the bed and the body position of the user including the position (sleeping position) of the user and the posture (sleeping posture) of the user, for example.

For example, the judgment unit 1010 may judge which of a supine position, a prone position, and a lateral position (a right lateral position and a left lateral position) the user is in. In addition, the judgment unit 1010 may judge where the user is sleeping on the mattress. Further, the judgment unit 1010 may judge, as the posture of the user, which sitting position (a sitting position with his/her soles of feet on the floor or a long sitting position) the user is in.

The body position changer 1020 is configured to change the body position of the user by controlling the sub-cell 130. When the sub-cell 130 is arranged as illustrated in FIGS. 6A-C for example, the body position changer performs control to inflate/deflate the sub-cells sequentially in the order of the lower right sub-cell 130WR, the upper right sub-cell 130SR, the upper left sub-cell 130SL, and the lower left sub-cell 130WL. By iterating the inflation/deflation of these sub-cells 130 in this manner, it is possible to change the body position by means of the Small Change method.

The memory 1300 is a functional unit in which various programs and various data required for the operation of the mattress 10 are stored. For example, the memory 1300 is constituted of a semiconductor memory, an HDD (Hard Disk Drive), and the like.

The memory 1300 may store a control table 1310. The control table 1310 is configured to store a control pattern which is the timing for inflating the sub-cell 130, for example. The body position changer 1020 controls the timing for the inflation operation of the sub-cell 130 based on the control pattern stored in the control table 1310.

A user interface unit 1400 is configured to accept manipulation inputs from the operator. Examples of the user interface unit include a user interface remote controller including one or multiple user interface buttons and a terminal device which is connected to the mattress and capable of displaying a user interface screen thereon (an information processor such as a smartphone and a tablet and a terminal device used in other medical systems, for example).

The user interface unit 1400 is capable of manipulating the mattress 10, but may also be capable of manipulating the bed body 20. In addition, the user interface unit 1400 may be added to a user interface unit of the bed body 20 as a user interface button which enables manipulation of the mattress 10.

A display 1500 is configured to display the state of the mattress and the manipulation state to the operator. The display 1500 is any of display devices including an LED lamp, a 7-segment LED, a liquid crystal display, and an organic EL panel. In addition, when the terminal device is connected to the mattress, the display 1500 uses a display device of the terminal device. Further, the display 1500 may be provided to the user interface unit 1400, or may alternatively be provided integrally with the user interface unit 1400 as a touch panel capable of touch manipulation.

A notifying unit 1550 is configured to notify the user and the operator. The notifying unit 1550 performs notifications in various ways by outputting an alarm and a beep with a speaker and the like, displaying a warning on the display 1500, generating vibrations by a vibrator, and generating flashes by a light emitting device, for example.

The detection unit 1600 is a sensor configured to detect various states. For example, the detection unit 1600 may detect the pressure of the air cells using a pressure sensor and detect the state of the mattress 10 and then the state of the bed body 20 using an angular sensor. These sensors may be embedded into the mattress 10 or alternatively may be provided outside the mattress. Alternatively, a sensor provided to the bed body 20 may acquire the detected value. An example of such a sensor in this embodiment is the sensor 150, for example.

When the detection unit 1600 functions as the sensor 150, the detection unit may further include the measurement unit 1602. The measurement unit 1602 is configured to measure a change of the capacitance, for example. Then, the measurement unit 1602 outputs a change value by which the capacitance has changed to the control unit 1000. Note that, the measurement unit 1602 may be implemented by the control unit 1000.

Note that, the mattress 10 may further include a function additionally required other than the configuration in FIG. 8A. For example, the mattress may further include a communicator for communicating with other terminal devices. Alternatively, the mattress may include a required configuration only. For example, the mattress has only to include at least the control unit 1000 and the memory 1300, and may include the user interface unit 1400, the display 1500, the notifying unit 1550, and the detection unit 1600 according to need.

FIG. 8A is a diagram illustrating the entire system 1 (mattress 10). For example, FIG. 8B illustrates an example of its specific configuration. The mattress 10 in FIG. 8B includes, in the pump unit 182, the function of the control device and the pump (the pump 180 of FIG. 3, for example). By controlling the pump 180, the control device discharges the air into the air cells and takes in the air from the air cells to control the pressure of the air cells.

In addition, the pump unit 182 has the control unit 1000 and the memory 1300 as the control device. Further, the pump unit 182 is connected to the user interface panel 185 and the detection unit 1600.

The user interface panel 185 has a control unit 1002 that is configured to control the user interface panel 185 itself, the user interface unit 1400, the display 1500, and the notifying unit 1550. The user interface panel 185 is configured to output a manipulation signal to the control unit 1000. The user interface panel 185 is also configured to display information and notify information based on a signal received from the control unit 1000.

Meanwhile, the detection unit 1600 is the sensor 150 for example, and can be added as needed.

Necessary information is transmitted and received among the pump unit 182, the user interface panel 185, and the detection unit 1600. For example, when the user interface device includes the control unit 1000 and the memory 1300, the user interface panel 185 may directly control the pump 180.

Alternatively, such control may be implemented using a terminal device such as a smartphone instead of the user interface device. This can be implemented by installing an application which implements the function of the user interface panel 185 in the terminal device and executing the application. Likewise, other configurations may be implemented by either the mattress or another control device.

Meanwhile, the pump unit 182 may be connected to the bed body 20. By connecting the pump unit to the bed body 20, it is possible to control the section and detect the section angle, for example.

Note that, in the pump unit 182, the control device (the control unit 1000 and the memory 1300) may be provided integrally with a control substrate of the pump 180, or alternatively may be provided separately from the pump 180 and connected to the pump.

6. EFFECT

In this way, according to this embodiment, unlike the existing air cells, it is possible to provide air cells having a shape fitted to the body of the user. Unlike the existing linear air cells, the sub-cells of this embodiment make it possible to increase the contact area with the body of the user. In addition, since the air cells of this embodiment inflate along the body line of the user, the air cells can support the user on a surface basis rather than a spot basis.

Further, since the contact area between the sub-cells of this embodiment and the user is increased, their body pressure dispersion performance is improved. Besides, use of the sub-cells of this embodiment helps stabilize the posture of the user and thus makes muscles less likely to contract.

FIG. 9 is a chart illustrating the result of measuring, by sensory assessment, an air mattress using the sub-cells of this disclosure described above and an air mattress using the existing sub-cells in terms of the level of sleeping comfort, displacement, and muscle tone for multiple examinees. Note that, the statistics is performed using the paired sample mean test.

Here, the assessment criteria are as follows.

(1) Sleeping Comfort

This criterion is set such that the level "sleeping comfort is so poor that one cannot sleep" is scored as 1, the level "sleeping comfort is very poor" is scored as 2, the level "sleeping comfort is poor" is scored as 3, the level "sleeping comfort is slightly poor" is scored as 4, and the level "no change" is scored as 5. In other words, this criterion indicates that the higher the weighting score the better the sleeping comfort.

(2) Displacement

This criterion is set such that the level "feel displacement force so heavily that one wants to be relieved of this force" is scored as 1, the level "feel displacement force so much" is scored as 2, the level "feel displacement force" is scored as 3, the level "feel displacement force a little" is scored as 4, and the level "no change in displacement force" is scored as 5. In other words, this criterion indicates that the higher the weighting score the better the sleeping comfort.

(3) Muscle Tone

This criterion is set such that the level "so heavy that one wants to move his/her body" is scored as 1, the level "very painful" is scored as 2, the level "painful" is scored as 3, the level "slightly painful" is scored as 4, and the level "no change" is scored as 5. In other words, this criterion indicates that the higher the weighting score the better the sleeping comfort.

The assessment result illustrated in FIG. 9 clearly shows that the mattress of this disclosure is improved to be better than the existing mattress in terms of every assessment criterion. In particular, the mattress of this disclosure is improved to be better than the existing mattress in terms of sleeping comfort and displacement.

In addition, according to the sub-cell of this embodiment, the sub-cells of the same shape can be used to properly arrange the sub-cells on the upper half of the body of the user and on the lower half of the body of the user. Thereby, according to the sub-cell of this embodiment, sub-cells of a single shape (one product) can cover multiple parts, thus making it possible to provide a low-cost air cell. Further, according to the sub-cell of this embodiment, it is no longer necessary to prepare air cells of multiple shapes in facilities and the like using air cells, so that effects such as easy management, easy maintenance, and running cost reduction can be expected.

Furthermore, according to the sub-cell of this embodiment, sub-cells of a single shape can support the lower half of the body of the user at multiple parts such as buttocks and thighs.

7. MODIFICATION EXAMPLE

Hereinabove, the embodiment of this disclosure has been described in detail with reference to the drawings. However, a specific configuration is not limited to that of this embodiment, and any design and the like within a range not departing from the gist of this disclosure are also included in the scope of claims.

[7.1 Configuration of Sub-Cell]

Although the above embodiment has been described such that all of the sub-cells have the same shape, the sub-cells may have different shapes. For example, the sub-cells arranged on the upper half of the body of the user may have any shape as long as they extend from both sides of the user's lumbar spine toward his/her shoulder blade outer edges.

Figure 10:
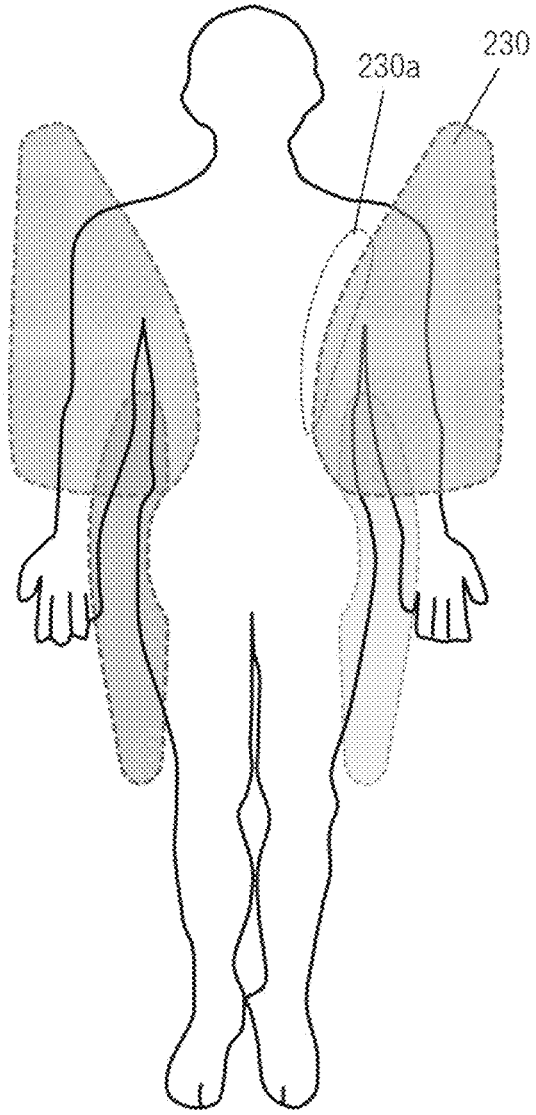
FIG. 10 is a diagram illustrating another configuration of the sub-air cells of this disclosure.

For example, as illustrated in FIG. 10, the sub-cells 130 do not necessarily have to be arranged in a V-shape. Sub-cells 230 in FIG. 10 support the range, extending from both sides of the user's lumbar spine to his/her shoulder blade outer edges, with their R-shaped regions R230*a*. In this manner, the sub-cell may have any shape as long as it has an R-shape at a position near the range extending from both sides of the user's lumbar spine toward his/her shoulder blade outer edges.

Figure 11:
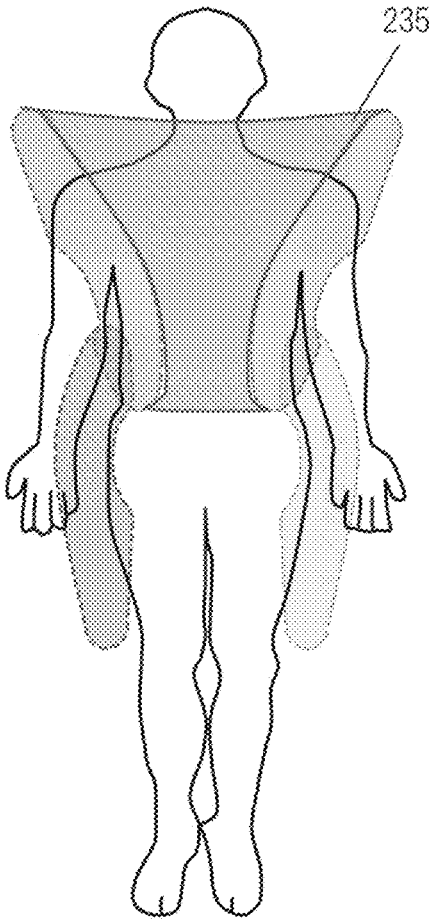
FIG. 11 is a diagram illustrating still another configuration of the sub-air cells of this disclosure.

In addition, although the left and right sub-cells 130 are provided in the above embodiment, they may be formed in one unit. For example, as illustrated in FIG. 11, a sub-cell 235 is formed as one sub-cell. The sub-cell 235 may be formed by connecting two sub-cells in one unit through an air cell film and the like, or alternatively may be formed so as to have R-shaped bulges by providing walls in one air cell.

[7.2 Configuration of Mattress]

Figure 12:
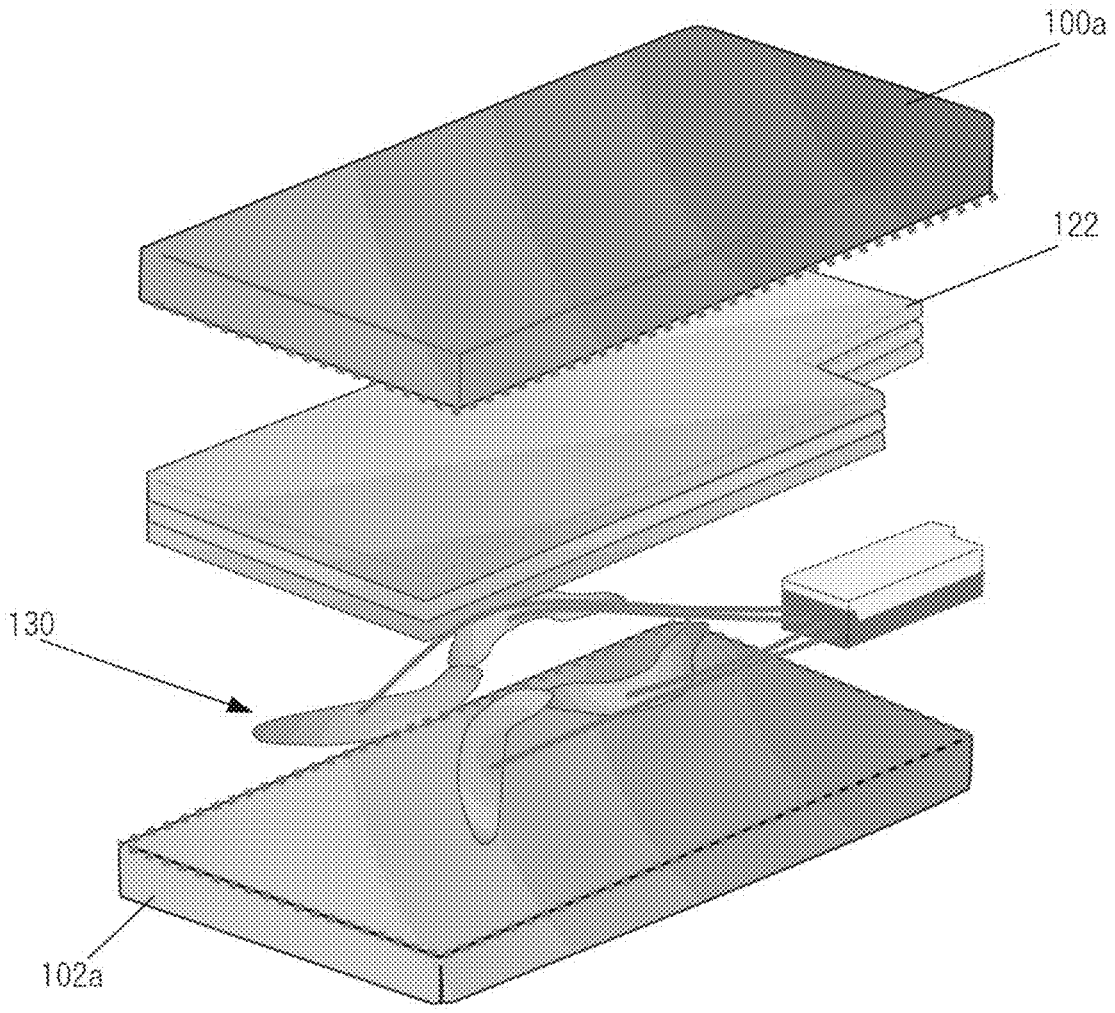
FIG. 12 is a view illustrating another configuration of the mattress of this disclosure.

Although the above embodiment has been described such that the mattress is constituted of the air cells, the mattress may have other configurations. For example, as illustrated in FIG. 12, a mattress disposed between an upper cover 100*a* and a lower cover 102*a* may be a urethane mattress 122. At this time, the sub-cell 130 may be disposed below the urethane mattress 122 as illustrated in FIG. 12. Note that, the sub-cell 130 may be disposed above the urethane mattress 122.

[7.3 Layout of Sub-Cell]

The above embodiment has been described such that the sub-cell 130 is provided inside the air mattress such as below the main cell 120 constituting the mattress or above the main cell 120. However, the sub-cell 130 may have a configuration separate from the mattress.

Figure 13:
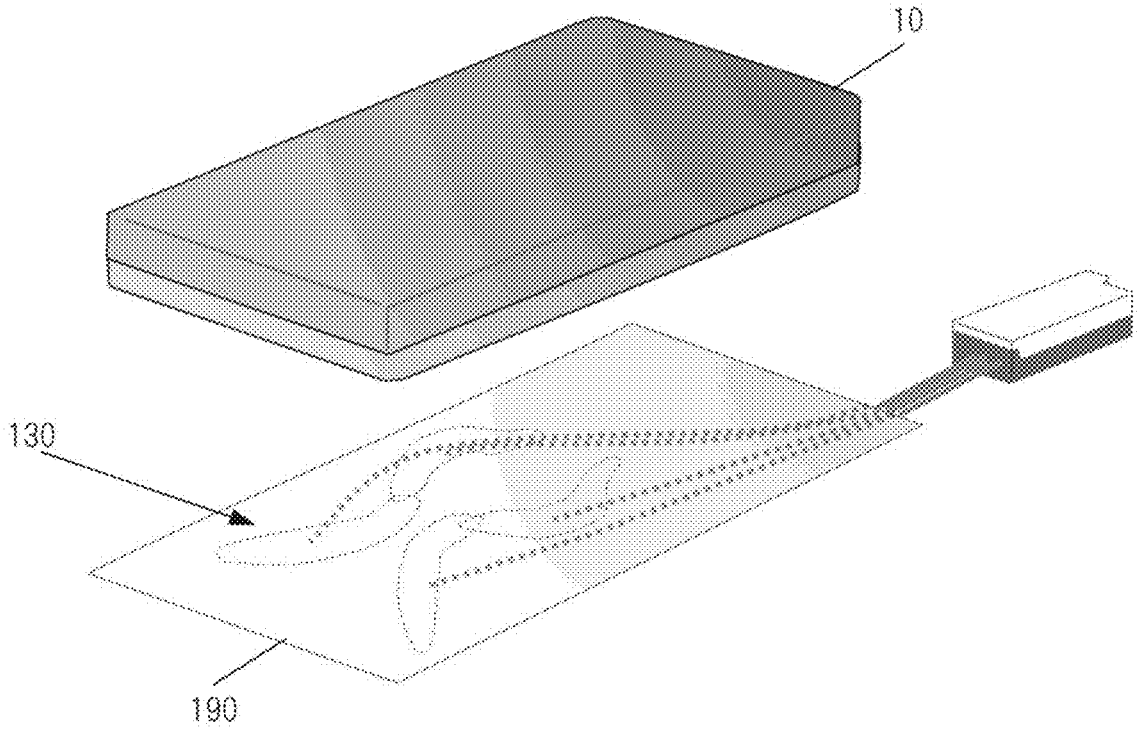
FIG. 13 is a view illustrating still another configuration of the mattress of this disclosure.

For example, in FIG. 13, the sub-cell 130 is of an underlay type in which it is disposed below the mattress 10. In this case, the mattress 10 may be an existing mattress, and thus the sub-cell 130 of the above embodiment can be disposed readily. Thereby, it is possible to add the body position changing function, provided by the sub-cell, to the existing mattress readily without preparing a dedicated mattress. Note that, the sub-cell 130 may be of an overlay type in which it is laid over the existing mattress.

Specifically, the sub-cell 130 may be constituted of one sheet. For example, a sub-cell sheet 190 of FIG. 13 has multiple spaces. By feeding the air from the pump 180 to these spaces, the spaces inflate to function as the sub-cell. In other words, since the spaces inflate or deflate when the air is fed to or discharged from the spaces provided in the sheet, these spaces have the same function as the sub-cell.

In this manner, in the case of the sub-cell sheet 190 in which a sheet-shaped sub-cell is formed integrally, the same effect can be expected by merely installing the sub-cell sheet 190 below the mattress 10. Alternatively, the sub-cell sheet 190 may be installed above the mattress 10.

[7.4 Position of Sub-Cell]

The above embodiment has been described such that the most appropriate example of the sub-cell 130 is one having a curved shape. Since the sub-cell 130 may have any shape as long as it is located so as to extend along the user's shoulder blade outer edges, substantially linear sub-cells 130 arranged in a V-shape can also exhibit a certain effect, for example.

Figure 14:
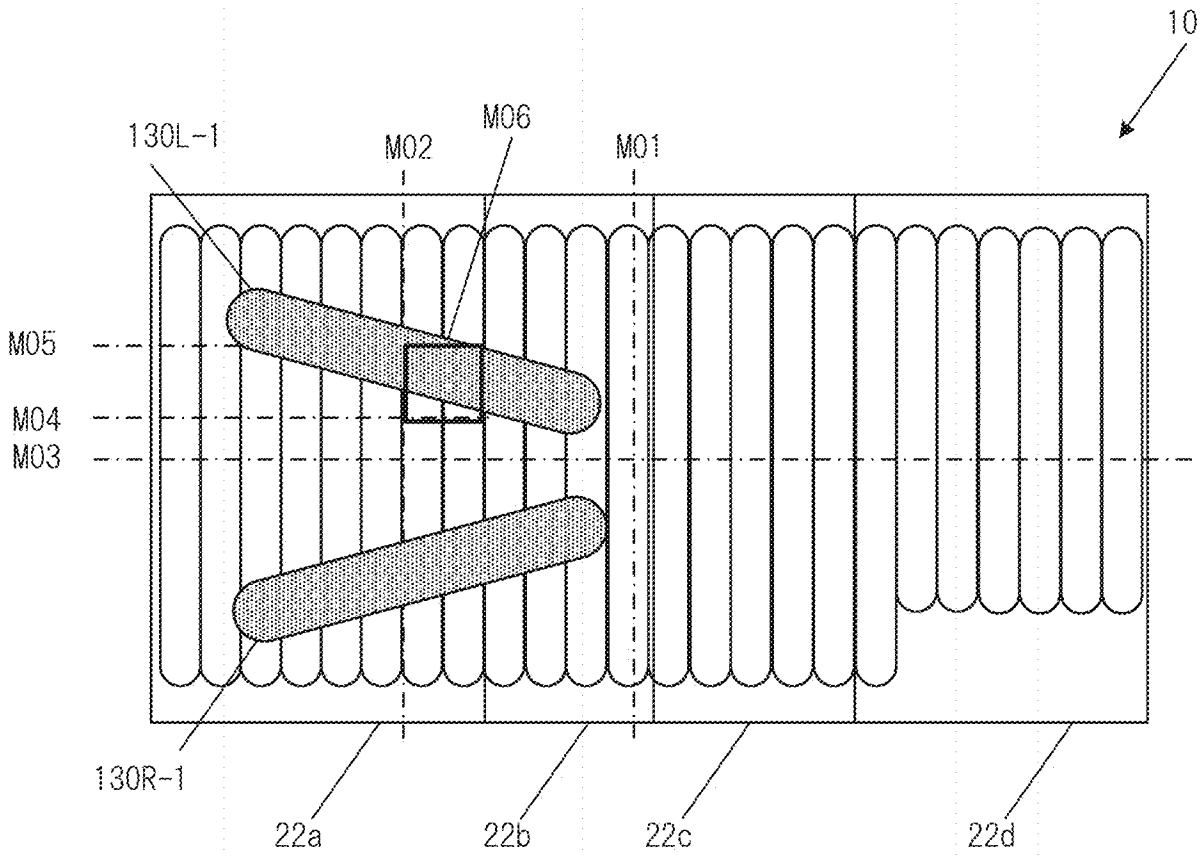
FIG. 14 is a view illustrating still another configuration of the positions of the sub-air cells of this disclosure.

For example, FIG. 14 is a view in which a left sub-cell 130L-1 and a right sub-cell 130R-1 are arranged in FIG. 7 as the substantially linear sub-cells 130. In this case, it is possible to achieve a certain effect by arranging the sub-cells 130 in a V-shape as viewed from the foot side of the mattress 10 (or a reverse V-shape as viewed from the foot side of the mattress 10) for example so that each sub-cell may be located at a position included in the rectangular region M06.

[7.5 Shape of Sub-Cell]

The above embodiment has been described such that the sub-cell 130 has an R-shaped curve as a convex shape so as to extend along the user's shoulder blade outer edges. The sub-cell 130 may have other shapes as long as it has a shape supporting the user's shoulder blade outer edges.

Figure 15:
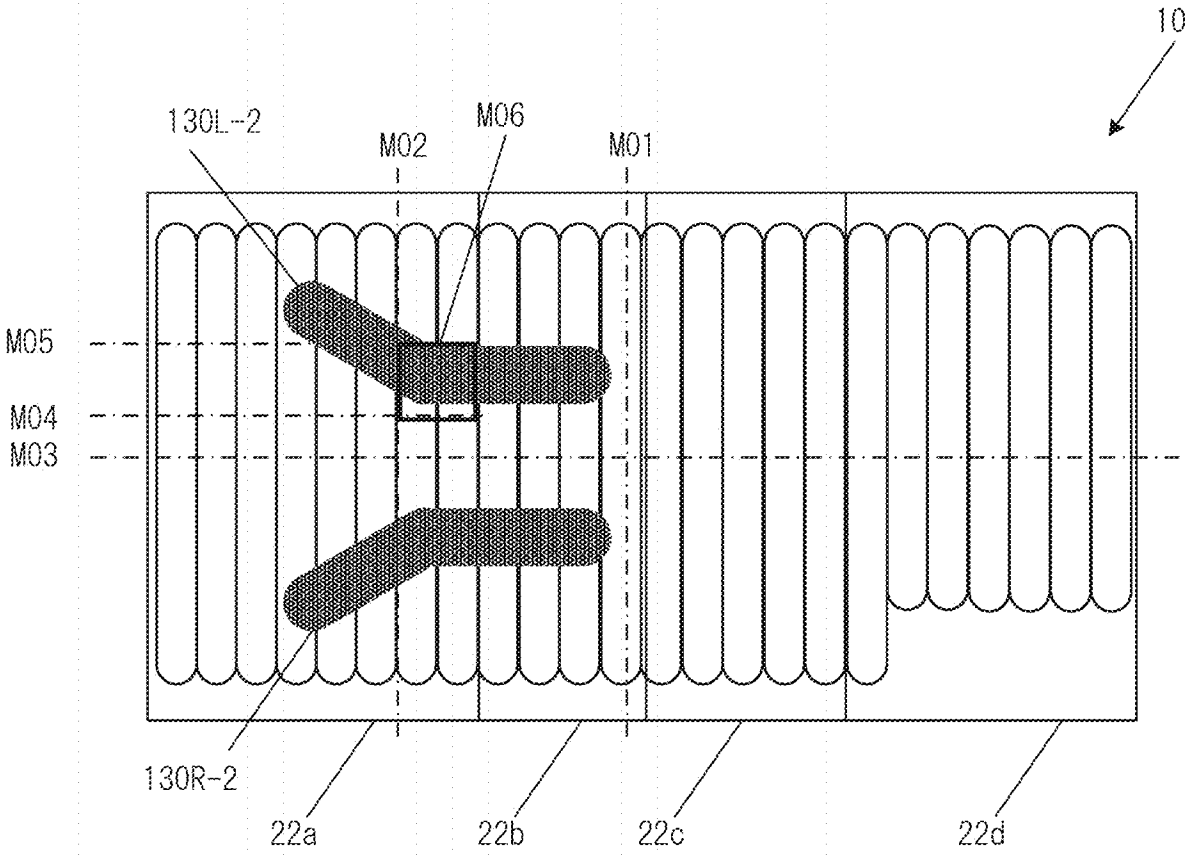
FIG. 15 is a view illustrating still another configuration of the positions of the sub-air cells of this disclosure.

For example, FIG. 15 is a view in which a left sub-cell 130L-2 and a right sub-cell 130R-2 are arranged in FIG. 7 as the convex-shaped sub-cells 130. In this case, the sub-cells 130 are arranged so that their convex-shaped protruding portions may be located near the user's shoulder blade outer sides. Note that, the sub-cell 130 may have a shape other than that of FIG. 15, such as a polygonal shape. The sub-cell 130 may have any shape as long as at least the convex shape (protruding portion or curved portion) of the sub-cell is located near the user's shoulder blade outer sides and a certain range (edge portion) of the sub-cell is disposed so as to extend along the user's shoulder blade outer edges.

[7.6 Configuration of Section]

Meanwhile, although the above embodiment has been described such that the section of the bed body mainly has a configuration including the back section, the curved section, the upper leg section, and the lower leg section, the configuration of the section is not limited to the above configuration. For example, in general, the curved section may have the function of the back section and may have the function of the seat section. In addition, in the configuration of the section, the lower leg section may be configured integrally with the upper leg section. Further, by being divided into multiple parts, the back section may be configured to exhibit the same effect as the curved section (for example, an effect such that, among the back sections thus divided, the back section located on the foot side supports the waist of the user). The curved section may also be referred to as the seat section.

While certain embodiments have been described, these embodiments have been presented by way of example only, and are not intended to limit the scope of the inventions. Indeed, the novel embodiments described herein may be embodied in a variety of other forms; furthermore, various omissions, substitutions and changes in the form of the embodiments described herein may be made without departing from the spirit of the inventions. The accompanying claims and their equivalents are intended to cover such forms or modifications as would fall within the scope and spirit of the inventions.

The invention claimed is:

1. A mattress, comprising:

first air cells extending in a short side direction of the mattress;

second air cells that are located on both sides of a user and located under the first air cells;

a pump provided adjacent to the first and second air cells; and a sensor provided outside the pump and including a positive electrode and a GND sheet, a cushion sheet being provided between the positive electrode and the GND sheet, wherein at least one of the second air cells has a convex shape on a first side, the at least one of the second air cells extending in a first direction, the first direction being oblique to a longitudinal direction of the mattress, and the second air cells are arranged so that the convex shapes thereof are respectively located near shoulder blade outer edges of the user.

2. The mattress according to claim 1, wherein the second air cells are arranged so that the convex shapes thereof respectively extend from sides of a lumbar spine of the user along the shoulder blade outer edges.

3. The mattress according to claim 1, wherein the second air cells each have a concave shape on a second side surface, and the second air cells are capable of being arranged so that the concave shapes thereof are located at positions respectively surrounding buttocks of the user when arranged so that the second side surfaces thereof face the user.

4. The mattress according to claim 3, wherein all of the second air cells that are arranged on the left and right of the user so as to be located near the shoulder blade outer edges of the user and the second air cells that are arranged on the left and right of the user so as to be located at positions surrounding the buttocks of the user have the same shape.

5. The mattress according to claim 1, wherein the second air cells each have a substantially linear shape on a second side surface, and the second air cells are capable of being arranged so as to be located at positions respectively supporting thighs of the user when arranged so that the second side surfaces thereof face the user.

6. The mattress according to claim 5, wherein all of the second air cells that are arranged on the left and right of the user so as to be located near the shoulder blade outer edges of the user and the second air cells that are arranged on the left and right of the user so as to be located at positions supporting the thighs of the user have the same shape.

7. The mattress according to claim 1, wherein the convex-shaped first side surface of each second air cell has a curved shape.

8. The mattress according to claim 2, wherein the second air cells each have a concave shape on a second side surface, and the second air cells are capable of being arranged so that the concave shapes thereof are located at positions respectively surrounding buttocks of the user when arranged so that the second side surfaces thereof face the user.

9. The mattress according to claim 2, wherein the second air cells each have a substantially linear shape on a second side surface, and the second air cells are capable of being arranged so as to be located at positions respectively supporting thighs of the user when arranged so that the second side surfaces thereof face the user.

10. The mattress according to the claim 1, wherein the at least one of the second air cells has a concave shape on a second side, the first side corresponding to a side near the user, the second side corresponding to a side far from the user.

11. The mattress according to claim 1, wherein the at least one of the second air cells includes a first area, a second area, and a third area, the second area being located between the first area and the third area, the first area having the convex shape on the first side, the second area having the concave shape on the second side, and the third area having a substantially liner shape on the second side.

12. The mattress according to claim 1, further comprising:

a plurality of main air cells disposed on the second air cells, each main air cell arranged in the longitudinal direction of the mattress, wherein the second air cell extends a second direction and an angle between the first direction and the longitudinal direction is between 15 degrees and 36 degrees.

13. A mattress including:

first air cells extending in a short side direction of the mattress;

second air cells that are located on both sides of a user and located under the first air cells;

a pump provided adjacent to the first and second air cells; and a sensor provided outside the pump and including a positive electrode and a GND sheet, a cushion sheet being provided between the positive electrode and the GND sheet, wherein, in a plan view of the mattress, the second air cells are arranged in a V-shape so as to extend from a central part of the mattress toward the outer side and extend along shoulder blade outer edges of the user, and at least one of the second air cells extends in a first direction, the first direction being oblique to a longitudinal direction of the mattress.

14. The mattress according to claim 13, wherein the air second cells each have a curved shape.

15. The mattress according to claim 14, wherein the second air cells each have a convex shape on a first side surface.

* * * * *